US009031270B2

(12) United States Patent
Pontoppidan

(10) Patent No.: US 9,031,270 B2
(45) **Date of Patent: *May 12, 2015**

(54) METHOD, A LISTENING DEVICE AND A LISTENING SYSTEM FOR MAXIMIZING A BETTER EAR EFFECT

(75) Inventor: Niels Henrik Pontoppidan, Smørum (DK)

(73) Assignee: Oticon A/S, Smorun (DK)

( * ) Notice: Subject to any disclaimer, the term of this patent is extended or adjusted under 35 U.S.C. 154(b) by 324 days.

This patent is subject to a terminal disclaimer.

(21) Appl. No.: 13/592,070

(22) Filed: Aug. 22, 2012

(65) Prior Publication Data

US 2013/0051565 A1 Feb. 28, 2013

Related U.S. Application Data

(60) Provisional application No. 61/526,277, filed on Aug. 23, 2011.

(30) Foreign Application Priority Data

Aug. 23, 2011 (EP) ..... 11178450

(51) Int. Cl.
*H04R 25/00* (2006.01)

(52) U.S. Cl.
CPC ..... *H04R 25/353* (2013.01); *H04R 25/552* (2013.01); *H04R 2225/43* (2013.01); *H04S 2420/01* (2013.01); *H04R 25/407* (2013.01)

(58) Field of Classification Search
CPC .. H04R 25/353; H04R 2225/43; H04R 25/70; H04R 25/00; H04R 2430/03; H04R 25/552; H04S 2420/01
USPC ..... 381/23.1, 312, 313, 314, 316, 320, 310, 381/60, 92, 97, 98, 119; 704/231, 233
See application file for complete search history.

(56) References Cited

U.S. PATENT DOCUMENTS 4,366,349 A * 12/1982 Adelman ..... 381/316
8,135,139 B2 * 3/2012 Neher et al. ..... 381/60

(Continued)

FOREIGN PATENT DOCUMENTS

EP 1699261 A1 6/2006
EP 1686566 A2 8/2006

(Continued)

OTHER PUBLICATIONS

T. Neher et al.: "Word recognition and sound localization as they relate to spatial hearing", Spatial Hearing and Understanding Speech in Complex Environments, Nov. 2008, Retrieved from http://www.hearingreview.com/issues/articles/2008-11_03.asp. pp. 1-5.

(Continued)

*Primary Examiner* — Vivian Chin
*Assistant Examiner* — Jason R Kurr
(74) *Attorney, Agent, or Firm* — Birch, Stewart, Kolasch & Birch, LLP

(57) ABSTRACT

A method of processes audio signals picked up from a sound field by a microphone system of a listening device adapted for being worn at a particular one of the left or right ear of a user, the sound field comprising sound signals from one or more sound sources, the sound signals impinging on the user from one or more directions relative to the user. Information about a user's Ear, Head, and Torso Geometry and the user's hearing ability in combination with knowledge of the spectral profile and location of current sound sources provide the means for deciding upon which frequency bands that, at a given time, contribute most to the BEE seen by the listener or the Hearing Instrument. For a given sound source, a number of donor frequency bands is determined at a given time, where an SNR-measure for the selected signal is above a predefined threshold.

19 Claims, 9 Drawing Sheets

(56) References Cited

U.S. PATENT DOCUMENTS

| | | | | |
|---|---|---|---|---|
| 8,270,643 | B2 * | 9/2012 | Kjems et al. | 381/312 |
| 8,503,704 | B2 * | 8/2013 | Francart et al. | 381/313 |
| 8,526,647 | B2 * | 9/2013 | Pedersen et al. | 381/313 |
| 2004/0175008 | A1 | 9/2004 | Roeck et al. | |
| 2004/0175010 | A1 | 9/2004 | Allegro et al. | |
| 2007/0127748 | A1 | 6/2007 | Carlile et al. | |
| 2009/0074197 | A1 | 3/2009 | Neher et al. | |

FOREIGN PATENT DOCUMENTS

| | | | |
|---|---|---|---|
| EP | 1742509 | A1 | 10/2007 |
| EP | 2026601 | A1 | 2/2009 |
| EP | 2131610 | A1 | 12/2009 |

OTHER PUBLICATIONS

Bell et al., "An information-maximization approach to blind separation and blind deconvolution," Neural Compulation, vol. 7, No. 6, 1995, pp. 1129-1159.

Boldt et al., "Estimation of the Ideal Binary Mask Using Directional Systems," International Workshop on Acoustic Signal Enhancement, 2008, 4 pages.

Bronkhorst, "The Cocktail Party Phenomenon: A Review of Research on Speech Intelligibility in Multiple-Talker Conditions," ACUSTICA—acta acustica, vol. 86, 2000, pp. 117-128.

Gardner et al., "HRTF Measurements of a KEMAR Dummy-Head Microphone," MIT Media Lab Perceptual Computing—Technical Report #280, MIT Media Lab Machine Listening Group, May 1994, pp. 1-7.

Goodwin, "The STFT, Sinusoidal Models, and Speech Modification," Sinusoidal Models, and Speech modification, Springer Handbook of Speech Processing, Chapter 12, 2008, pp. 229-258.

Jourjine et al., "Blind Separation of Disjoint Orthogonal Signals: Demixing N Sources From 2 Mixtures," IEEE International Conference on Acoustics, Speech, and Signal Processing, 2000, pp. 2985-2988.

Middlebrooks et al., "Sound Localization by Human Listeners," Annual Review of Psychology, vol. 42, 1991, pp. 135-159.

Pedersen et al., "Convolutive Blind Source Separation Methods," Survey of Convolutive Blind Source Separation Methods, Chapter 52, Springer Handbook of Speech Processing, 2008, pp. 1065-1094.

Pedersen et al., "Separating Underdetermined Convolutive Speech Mixtures," ICA 2006, LNCS 3889, 2006, pp. 674-681.

Roweis, "One Microphone Source Separation," Neural Information Processing Systems (NIPS), 2000, pp. 793-799.

Wang, "On Ideal Binary Mask as the Computational Goal of Auditory Scene Analysis," Speech Separation by Humans and Machines, Chapter 12, 2005, pp. 181-197.

Wightman et al., "Factors Affecting the Relative Salience of Sound Localization Cues," Binaural and Spatial Hearing in Real and Virtual Enviornments (Editors: Gilkey et al.), 1997, pp. 1-23.

* cited by examiner

METHOD, A LISTENING DEVICE AND A LISTENING SYSTEM FOR MAXIMIZING A BETTER EAR EFFECT

CROSS REFERENCE TO RELATED APPLICATIONS

This nonprovisional application claims priority under 35 U.S.C. 119(e) to U.S. Provisional Application No. 61/526,277 filed on Aug. 23, 2011 and under 35 U.S.C. 119(a) to patent application Ser. No. 11/178,450.0 filed in Europe, on Aug. 23, 2011. The entire contents of all of the above applications are hereby incorporated by reference into the present.

TECHNICAL FIELD

The present application relates to listening devices, e.g. listening systems comprising first and second listening devices, in particular to sound localization and a user's ability to separate different sound sources from each other in a dynamic acoustic environment, e.g. aiming at improving speech intelligibility. The disclosure relates specifically to a method of processing audio signals picked up from a sound field by a microphone system of a listening device adapted for being worn at a particular one of the left or right ear of a user. The application further relates to a method of operating a bilateral listening system, to a listening device, to its use, and to a listening system.

The application further relates to a data processing system comprising a processor and program code means for causing the processor to perform at least some of the steps of the method and to a computer readable medium storing the program code means.

The disclosure may e.g. be useful in applications such as hearing aids for compensating a user's hearing impairment. The disclosure may specifically be useful in applications such as hearing instruments, headsets, ear phones, active ear protection systems, or combinations thereof.

BACKGROUND

A relevant description of the background for the present disclosure is found in EP 2026601 A1 from which most of the following is taken.

People who suffer from a hearing loss most often have problems detecting high frequencies in sound signals. This is a major problem since high frequencies in sound signals are known to offer advantages with respect to spatial hearing such as the ability to identify the location or origin of a detected sound ("sound localisation"). Consequently, spatial hearing is very important for people's ability to perceive sound and to interact with and navigate in their surroundings. This is especially true for more complex listening situations such as cocktail parties, in which spatial hearing can allow people to perceptually separate different sound sources from each other, thereby leading to better speech intelligibility [Bronkhorst, 2000].

From the psychoacoustic literature it is apparent that, apart from interaural temporal and level differences (abbreviated ITD and ILD, respectively), sound localisation is mediated by monaural spectral cues, i.e. peaks and notches that usually occur at frequencies above 3 kHz [Middlebrooks and Green, 1991], [Wightman and Kistler, 1997]. Since hearing-impaired subjects are usually compromised in their ability to detect frequencies higher than 3 kHz, they suffer from reduced spatial hearing abilities.

Frequency transposition has been used to modify selected spectral components of an audio signal to improve a user's perception of the audio signal. In principle, the term "frequency transposition" can imply a number of different approaches to altering the spectrum of a signal. For instance, "frequency compression" refers to compressing a (wider) source frequency region into a narrower target frequency region, e.g. by discarding every n-th frequency analysis band and "pushing" the remaining bands together in the frequency domain. "Frequency lowering" refers to shifting a high-frequency source region into a lower-frequency target region without discarding any spectral information contained in the shifted high-frequency band. Rather, the higher frequencies that are transposed either replace the lower frequencies completely or they are mixed with them. In principle, both types of approaches can be performed on all or only some frequencies of a given input spectrum. In the context of this invention, both approaches are intended to transpose higher frequencies downwards, either by frequency compression or frequency lowering. Generally speaking, however, there may be one or more high-frequency source bands that are transposed downwards into one or more low-frequency target bands, and there may also be other, even lower lying frequency bands remaining unaffected by the transposition.

Patent application EP 1742509 relates to eliminating acoustical feedback and noise by synthesizing an audio input signal of a hearing device. Even though this method utilises frequency transposition, the purpose of frequency transposition in this prior art method is to eliminate acoustical feedback and noise in hearing aids and not to improve spatial hearing abilities.

SUMMARY

Better Ear Effect from Adaptive Frequency Transposition is based on a unique combination of estimation of the current sound environment, the individual wearers hearing loss and possibly information about or related to their head- and torso-geometry.

The inventive algorithms provide a way of transforming the Better Ear Effect (BEE) observed by the Hearing Instruments into a BEE that the wearer can access by means of frequency transposition.

In a first aspect, Ear, Head, and Torso Geometry, e.g. characterized by Head Related Transfer Functions (HRTF), combined with knowledge of spectral profile and location of current sound sources, provide the means for deciding upon which frequency bands that, at a given time, contribute most to the BEE seen by the listener or the Hearing Instrument. This corresponds to the system outlined in FIG. 1.

In a second aspect, the impact of the Ear, Head, and Torso Geometry on the BEE is estimated without the knowledge of the individual HRTFs by comparing the estimated source signals across the ears. This corresponds to the system outlined in FIG. 2. This aspect is the main topic of our co-pending European patent application, filed on 23 Aug. 2011 with the title "A method and a binaural listening system for maximizing a better ear effect", which is hereby incorporated by reference.

In principle, two things must occur for the BEE to appear, the position of the present source(s) needs to evoke ILDs (Interaural Level Differences) in a frequency range for the listener and the present source(s) must exhibit energy at those frequencies where the ILDs are sufficiently large. These are called the potential donor frequency ranges or bands.

Knowledge of the hearing loss of a user, in particular the Audiogram and the frequency dependent frequency resolution, is used to derive the frequency regions where the wearer is receptive to the BEE. These are called the target frequency ranges or bands.

According to the invention an algorithm continuously changes the transposition to maximize the BEE. As opposed to static transposition schemes e.g. [Carlile et al., 2006], [Neher and Behrens, 2007], the present invention does, on the other hand, not provide the user with a consistent representation of the spatial information.

According to the present disclosure the knowledge of the spectral configuration of the current physical BEE is combined with the knowledge of how to make it accessible to the wearer of the Hearing Instrument.

An object of the present application is to provide an improved sound localization for a user of a binaural listening system.

Objects of the application are achieved by the invention described in the accompanying claims and as described in the following.

A Method of Processing Audio Signals in a Listening Device:

In an aspect, a method of processing audio signals picked up from a sound field by a microphone system of a listening device adapted for being worn at a particular one of the left or right ear of a user, the sound field comprising sound signals from one or more sound sources, the sound signals impinging on the user from one or more directions relative to the user is provided. The method comprises a) providing information about the transfer functions for the propagation of sound to the user's left and right ears, the transfer functions depending on the frequency of the sound signal, the direction of sound impact relative to the user, and properties of the head and body of the user;

b1) providing information about a user's hearing ability on the particular ear, the hearing ability depending on the frequency of a sound signal;

b2) determining a number of target frequency bands for the particular ear, for which the user's hearing ability fulfils a predefined hearing ability criterion;

c1) providing a dynamic separation of sound signals from the one or more sound sources for the particular ear, the separation depending on time, frequency and direction of origin of the sound signals relative to the user;

c2) selecting a signal among the dynamically separated sound signals;

c3) determining an SNR-measure for the selected signal indicating a strength of the selected signal relative to signals of the sound field, the SNR-measure depending on time, frequency and direction of origin of the selected signal relative to the user, and on the location and mutual strength of the sound sources;

c4) determining a number of donor frequency bands of the selected signal at a given time, where the SNR-measure for the selected signal is above a predefined threshold;

d) transposing at least one donor frequency band of the selected signal—at a given time—to a target frequency band, if a predefined transposition criterion is fulfilled.

This has the advantage of providing an improved speech intelligibility of a hearing impaired user.

In a preferred embodiment, the algorithm according to the present disclosure separates incoming signals to obtain separated source signals with corresponding localisation parameters (e.g. horizontal angle, vertical angle, and distance, or equivalent, or a subset thereof). The separation can e.g. be based on a directional microphone system, periodicity matching, statistical independence, combinations or alternatives. In an embodiment, the algorithm is used in listening devices of a bilateral hearing aid system, wherein intra listening device communication is provided allowing an exchange of separated signals and corresponding localisation parameters between the two listening devices of the system. In an embodiment, the method provides a comparison of separated source signals to estimate head related transfer functions (HRTF) for one, more or all separated source signals and to store the results in a HRTF database, e.g. in one or both listening devices (or in a device in communication with the listening devices). In an embodiment, the method allows an update of the HRTF database according to learning rule, e.g.

$HRTF_{db}(\theta_s, \phi_s, r, f)=(1-\alpha)\, HRTF_{db}(\theta_s, \phi_s, r, f)+\alpha HRTF_{est}(\theta_s, \phi_s, r, f)$, $\theta_s$, $\phi_s$, r are coordinates in a polar coordinate system, f is frequency and $\alpha$ is a parameter (between 0 and 1) determining the rate of change of the data base (db) value with the change of the currently estimated (est) value of the HRTF.

In an embodiment, the method comprises the step (c3') of determining a number of potential donor frequency bands for the particular ear for the selected signal and direction where a better ear effect function BEE related to the transfer functions for the propagation of sound to the user's left and right ears is above a predefined threshold. In an embodiment, one or more (e.g. all) of the number of donor frequency bands are determined among the potential donor bands.

In an embodiment, the predefined transposition criterion comprises that the at least one donor frequency band of the selected signal overlaps with or is identical to a potential donor frequency band of the selected signal. In an embodiment, the predefined transposition criterion comprises that no potential donor frequency band is identified in step c3') in the direction of origin of the selected signal. In an embodiment, the predefined transposition criterion comprises that the donor band comprises speech.

In an embodiment, the term 'signals of the sound field', in relation to determining the SNR measure in step c3), is taken to mean 'all signals of the sound field' or, alternatively, 'a selected sub-set of the signals of the sound field' (typically including the selected one) comprising the sound fields that are estimated to be the more important to the user, e.g. the those comprising the more signal energy or power (e.g. the signal sources which in common comprise more than a predefined fraction of the total energy or power of the sound sources of the sound field at a given point in time). In an embodiment, the predefined fraction is 50%, e.g. 80% or 90%.

In an embodiment, the transfer functions for the propagation of sound to the user's left and right ears comprise the head related transfer functions of the left and right ears $HRTF_l$ and $HRTF_r$, respectively. In an embodiment, head related transfer functions of the left and right ears $HRTLF_l$ and $HRTF_r$, respectively, are determined in advance of normal operation of the listening device and made available to the listening device during normal operation.

In an embodiment, in step c3') a better ear effect function related to the transfer functions for the propagation of sound to the user's left and right ears are based on an estimate of the interaural level difference, ILD, and wherein the interaural level difference of a potential donor frequency band is larger than a predefined threshold value $T_{ILD}$.

In an embodiment, steps c2) to c4) are performed for two or more, such as for all, of the dynamically separated sound signals, and wherein all other signal sources than the selected signal are considered as noise when determining the SNR-measure.

In an embodiment, in step c2) a target signal is chosen among the dynamically separated sound signals, and wherein step d) is performed for the target signal, and wherein all other signal sources than the target signal are considered as noise.

In an embodiment, the target signal is selected among the separated signal sources as the source fulfilling one or more of the criteria comprising: a) having the largest energy content, b) being located the closest to the user, c) being located in front of the user, d) comprising the loudest speech signal components. In an embodiment, the target signal is selectable by the user, e.g. via a user interface allowing a selection between the currently separated sound sources, or a selection of sound sources from a particular direction relative to the user, etc.

In an embodiment, signal components that are not attributed to one of the dynamically separated sound signals are considered as noise.

In an embodiment, step d) comprises substitution of the magnitude and/or phase of the target frequency band with the magnitude and/or phase of a donor frequency band. step d) comprises mixing of the magnitude and/or phase of the target frequency band with the magnitude and/or phase of a donor frequency band. In an embodiment, step d) comprises substituting or mixing of the magnitude of the target frequency band with the magnitude of a donor frequency band, while the phase of the target band is left unaltered. step d) comprises substituting or mixing of the phase of the target frequency band with the phase a donor frequency band, while the magnitude of the target band is left unaltered. step d) comprises substituting or mixing of the magnitude and/or phase of the target frequency band with the magnitude and/or phase of two or more donor frequency bands. In an embodiment, step d) comprises substituting or mixing of the magnitude and/or phase of the target frequency band with the magnitude from one donor band and the phase from another donor frequency band.

In an embodiment, donor frequency bands are selected above a predefined minimum donor frequency and wherein target frequency bands are selected below a predefined maximum target frequency. In an embodiment, the minimum donor frequency and/or the maximum target frequency is/are adapted to the users hearing ability.

In an embodiment, in step b2) a target frequency band is determined based on an audiogram. In an embodiment, in step b2) a target frequency band is determined based on the frequency resolution of the user's hearing ability. In an embodiment, in step b2) a target frequency band is determined as a band for which a user has the ability to correctly decide on which ear the level is the larger, when sounds of different levels are played simultaneously to the user's left and right ears. In other words, a hearing ability criterion can be related to one or more of a) the user's hearing ability is related to an audiogram of the user, e.g. the user's hearing ability is above a predefined hearing threshold at a number of frequencies (as defined by the audiogram); b) the frequency resolution ability of the user; c) the user's ability to correctly decide on which ear the level is the larger, when sounds of different levels are played simultaneously to the user's left and right ears.

In an embodiment, target frequency bands that contribute poorly to the wearer's current spatial perception and speech intelligibility are determined, such that their information may be substituted with the information from a donor frequency band. target frequency bands that contribute poorly to the wearer's current spatial perception are target bands for which a better ear effect function BEE is below a predefined threshold. In an embodiment, target frequency bands that contribute poorly to the wearer's speech intelligibility are target bands for which an SNR-measure for the selected signal indicating a strength of the selected signal relative to signals of the sound field is below a predefined threshold.

A Method of Operating a Bilateral Hearing Aid System:

In an aspect, a method of operating a bilateral hearing aid system comprising left and right listening devices each being operated according to a method as described above, in the 'detailed description of embodiments' and in the claims is provided.

In an embodiment, step d) is operated independently (asynchronously) in left and right listening devices.

In an embodiment, step d) is operated synchronously in left and right listening devices in that the devices share the same donor and target band configuration. In an embodiment, the synchronization is achieved by communication between the left and right listening devices, such mode of synchronization being termed binaural BEE estimation. In an embodiment, the synchronization is achieved via bilateral approximation to binaural BEE estimation, where a given listening device is adapted to be able to estimate what the other listening device will do without the need for communication between them.

In an embodiment, a given listening device receives the transposed signal from the other listening and optionally scales this according to the desired ILD.

In an embodiment, the ILD from a donor frequency band is determined and applied to a target frequency band of the same listening device.

In an embodiment, the ILD is determined in one of the listening devices and transferred to the other listening device and applied therein.

In an embodiment, the method comprises applying directional information to the signal based on a stored database of HRTF values. In an embodiment, the HRTF values of the database are modified (improved) by learning.

In an embodiment, the method comprises applying the relevant HRTF values to electrical signals to convey the perception of the true relative position of the sound source or a virtual position to the user.

In an embodiment, the method comprises applying the HRTF values to stereo-signals to manipulate source positions.

In an embodiment, the method comprises that a sound without directional information inherent in the signal, but with estimated, received, or virtual localisation parameters is placed according to the HRTF database by lookup and interpolation (using the non-inherent localisation parameters as entry parameters).

In an embodiment, the method comprises that a sound signal comprising directional information, is modified by HRTF database such that it is perceived to originate from another position than indicated by the inherent directional information. Such feature can e.g. be used in connection with gaming or virtual reality applications.

A Listening Device:

In an aspect, a listening device adapted for being worn at a particular one of the left or right ear of a user comprising a microphone system for picking up sounds from a sound field comprising sound signals from one or more sound sources, the sound signals impinging on the user wearing the listening device from one or more directions relative to the user is furthermore provided, the listening device being adapted to process audio signals picked up by the microphone system according to the method as described above, in the 'detailed description of embodiments' and in the claims.

In an embodiment, the listening device comprises a data processing system comprising a processor and program code means for causing the processor to perform at least some (such as a majority or all) of the steps of the method as described above, in the 'detailed description of embodiments' and in the claims.

In an embodiment, the listening device is adapted to provide a frequency dependent gain to compensate for a hearing loss of a user. In an embodiment, the listening device comprises a signal processing unit for enhancing the input signals and providing a processed output signal. Various aspects of digital hearing aids are described in [Schaub; 2008].

In an embodiment, the listening device comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the listening device comprises an input transducer for converting an input sound to an electric input signal. In an embodiment, the listening device comprises a directional microphone system adapted to separate two or more acoustic sources in the local environment of the user wearing the listening device. In an embodiment, the directional system is adapted to detect (such as adaptively detect) from which direction a particular part of the microphone signal originates. This can be achieved in various different ways as e.g. described in U.S. Pat. No. 5,473,701 or in WO 99/09786 A1 or in EP 2 088 802 A1.

In an embodiment, the listening device comprises an antenna and transceiver circuitry for wirelessly receiving a direct electric input signal from another device, e.g. a communication device or another listening device. In an embodiment, the listening device comprises a (possibly standardized) electric interface (e.g. in the form of a connector) for receiving a wired direct electric input signal from another device, e.g. a communication device or another listening device. In an embodiment, the direct electric input signal represents or comprises an audio signal and/or a control signal and/or an information signal. In an embodiment, the listening device comprises demodulation circuitry for demodulating the received direct electric input to provide the direct electric input signal representing an audio signal and/or a control signal e.g. for setting an operational parameter (e.g. volume) and/or a processing parameter of the listening device. In general, the wireless link established by a transmitter and antenna and transceiver circuitry of the listening device can be of any type. In an embodiment, the wireless link is used under power constraints, e.g. in that the listening device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

In an embodiment, the communication between the listening devices and possible other devices is in the base band (audio frequency range, e.g. between 0 and 20 kHz). Preferably, communication between the listening device and the other device is based on some sort of modulation at frequencies above 100 kHz. Preferably, frequencies used to establish communication between the listening device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range.

In an embodiment, the listening device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the listening device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the listening device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, the frequency range $f_{min}$-$f_{max}$ considered by the listening device is split into a number P of frequency bands, where P is e.g. larger than 5, such as larger than 10, such as larger than 50, such as larger than 100, at least some of which are processed individually. In an embodiment, the listening device is/are adapted to process their input signals in a number of different frequency ranges or bands. The frequency bands may be uniform or non-uniform in width (e.g. increasing in width with frequency), overlapping or non-overlapping.

In an embodiment, the listening device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment. Level detection in hearing aids is e.g. described in WO 03/081947 A1 or U.S. Pat. No. 5,144,675.

In a particular embodiment, the listening device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. A speech detector is e.g. described in WO 91/03042 A1.

In an embodiment, the listening device comprises an own voice detector for detecting whether a given input sound (e.g. a voice) originates from the voice of the user of the system. Own voice detection is e.g. dealt with in US 2007/009122 and in WO 2004/077090. In an embodiment, the microphone system of the listening device is adapted to be able to differentiate between a user's own voice and another person's voice and possibly from NON-voice sounds.

In an embodiment, the listening device comprises an acoustic (and/or mechanical) feedback suppression system. In an embodiment, the listening device further comprises other relevant functionality for the application in question, e.g. compression, noise reduction, etc.

In an embodiment, the listening device comprises a hearing aid, e.g. a hearing instrument, e.g. a hearing instrument adapted for being located at the ear or fully or partially in the ear canal of a user, e.g. a headset, an earphone, an ear protection device or a combination thereof.

A Hearing Aid System:

In a further aspect, a listening system comprising a listening device as described above, in the 'detailed description of embodiments', and in the claims, AND an auxiliary device is moreover provided.

In an embodiment, the system is adapted to establish a communication link between the listening device and the auxiliary device to provide that information (e.g. control and status signals, possibly audio signals) can be exchanged or forwarded from one to the other.

In an embodiment, the auxiliary device is an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the listening device.

In an embodiment, the auxiliary device is another listening device. In an embodiment, the listening system comprises two listening devices adapted to implement a binaural listening system, e.g. a binaural hearing aid system.

A Bilateral Hearing Aid System:

A bilateral hearing aid system comprising left and right listening devices as described above, in the 'detailed description of embodiments' and in the claims is furthermore provided.

A bilateral hearing aid system operated according to the method of operating a bilateral hearing aid system as described above, in the 'detailed description of embodiments' and in the claims is furthermore provided.

Use:

In an aspect, use of a listening device as described above, in the 'detailed description of embodiments' and in the claims, is moreover provided. In an embodiment, use is provided in a system comprising one or more hearing instruments, headsets, ear phones, active ear protection systems, etc.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The present disclosure relates to the Better Ear Effect and in particular to making it available to a hearing impaired person by Adaptive Frequency Transposition. The algorithms are based on a unique combination of an estimation of the current sound environment (including sound source separation), the individual wearers hearing loss and possibly information about or related to a user's head- and torso-geometry.

In a first aspect, Ear, Head, and Torso Geometry, e.g. characterized by Head Related Transfer Functions (HRTF), combined with knowledge of spectral profile and location of current sound sources, provide the means for deciding upon which frequency bands that, at a given time, contribute most to the BEE seen by the listener or the Hearing Instrument. This corresponds to the system outlined in FIG. 1.

Figure 1:
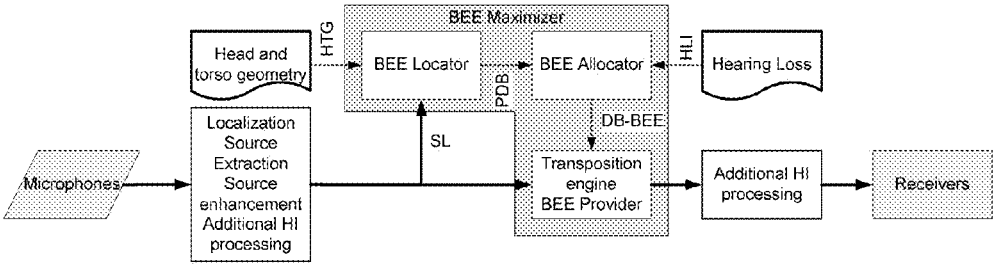
FIG. 1 shows a block diagram of an embodiment of a listening device comprising a BEE maximizer algorithm, implemented without exchanging information between listening devices located at left and right ears of a user, respectively (bilateral system)

FIG. 1 shows a block diagram of an embodiment of a listening device comprising a BEE maximizer algorithm, implemented without exchanging information between listening devices located at left and right ears of a user, respectively (bilateral system). The listening device comprises a forward path from an input transducer (Microphones) to an output transducer (Receivers), the forward path comprising a processing unit (here blocks (from left to right) Localization, Source Extraction, Source enhancement, Additional HI processing, and Transposition engine, BEE Provider and Additional HI processing) for processing (e.g. extracting a source signal, providing a resulting directional signal, applying a frequency dependent gain, etc.) an input signal picked up by the input transducer (here microphone system Microphones), or a signal derived therefrom, and providing an enhanced signal to the output transducer (here Receivers). The enhancement of the signal of the forward path comprises a dynamic application of a BEE algorithm as described in the present application. The listening device comprises an analysis path for analysing a signal of the forward path and influencing the processing of the signal path, including providing the basis for the dynamic utilization of the BEE effect. In the embodiment of a listening device illustrated in FIG. 1, the analysis path comprises blocks BEE Locator and BEE Allocator. The block BEE Locator is adapted to provide an estimate of donor range(s), i.e. the spectral location of BEE's, associated with the present sound sources, in particular to provide a set of potential donor frequency bands $DONOR_s(n)$ for a given sound source s, for which the BEE associated with source s is useful. The BEE Locator uses inputs concerning the head and torso geometry of a user of the listening device (related to the propagation of sound to the user's left and right ears) stored in a memory of the listening device (cf. signal HTG from medium Head and torso geometry), e.g. in the form of Head Related Transfer Functions stored in a memory of the listening device. The estimation ends up with a (sorted) list of bands that contribute to the better ear effect seen by the listening device(s) in question, cf. signal PDB which is used as an input to the BEE Allocator block. The block BEE Allocator provides a dynamic allocation of the donor bands with most spatial information (as seen by the listening device in question) to the target bands with best spatial reception (as seen by the wearer (user) of the listening device(s)), cf. signal DB-BEE which is fed to the Transposition engine, BEE Provider block. The BEE Allocator block identifies the frequency bands—termed target frequency bands—where the user has an acceptable hearing ability AND that contribute poorly to the wearer's current spatial perception and speech intelligibility such that their information may advantageously be substituted with the information with good BEE (from appropriate donor bands). The allocation of the identified target bands is performed in the BEE Allocator block based on the input DB-BEE input from the BEE Locator block and the input HLI concerning a user's (frequency dependent) hearing ability stored in a memory of the listening device (here medium Hearing Loss). The information about a user's hearing ability comprises e.g. a sorted list of how well frequency bands handle spatial information, and preferably includes the necessary spectral width of spatial cues (for a user to be able to differentiate two sounds of different spatial origin). As indicated by the enclosure BEE-MAX in FIG. 1, the blocks BEE Locator, BEE Allocator and Transposition engine, BEE Provider and Additional HI processing together form part of or constitute the BEE Maximizer algorithm. Other functional units may additionally be present (fully or partially located) in an analysis path of a listening device according to the present disclosure, e.g. feedback estimation and/or cancellation, noise reduction, compression, etc. The Transposition engine, BEE Provider block receives as inputs the input signal SL of the forward path and the DB-BEE signal from the BEE Allocator block and provides as an output signal TB-BEE comprising target bands with adaptively allocated BEE-information from appropriate donor bands. The enhanced signal TB-BEE is fed to the Additional HI processing block for possible further processing of the signal (e.g. compression, noise reduction, feedback reduction, etc.) before being presented to a user via an output transducer (here block Receivers). Alternatively or additionally, processing of a signal of the forward path may be performed in the Localization, Source Extraction, Source enhancement, Additional HI processing block prior to the BEE maximizer algorithm being applied to the signal of the forward path.

Figure 2:
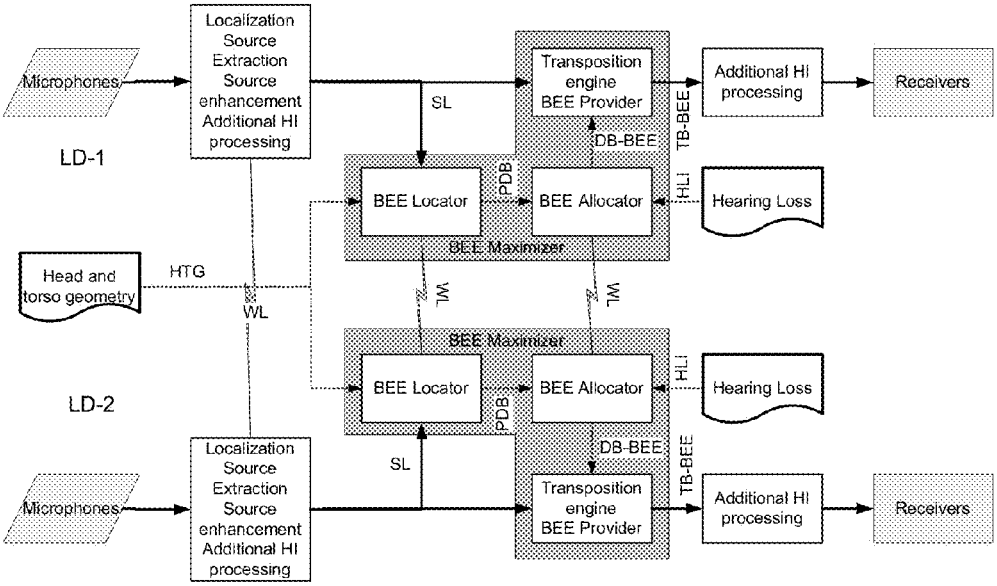
FIG. 2 shows a block diagram of an embodiment of a listening system comprising a BEE maximizer algorithm, implemented using exchange of information between the listening devices of the system located at left and right ears of a user, respectively (binaural system)

In a second aspect, the impact of the Ear, Head, and Torso Geometry on the BEE is estimated without the knowledge of the individual HRTFs by comparing the estimated source signals across the ears of a user. This corresponds to the system outlined in FIG. 2 showing a block diagram of an embodiment of a listening system comprising a BEE maximizer algorithm, implemented using exchange of information between the listening devices of the system located at left and right ears of a user, respectively (binaural system). The system of FIG. 2 comprises e.g. left and right listening devices as shown and described in connection to FIG. 1. In addition to the elements of the embodiment of a listening device shown in FIG. 1, the left and right listening devices (LD-1 (top device), LD-2 (bottom device)) of the system of FIG. 2 comprise transceivers for establishing a wireless communication link (WL) between them. Thereby information about donor frequency bands $DONOR_s(n)$ for a given sound source s, for which the BEE associated with source s is useful can be exchanged between the left and right listening devices (e.g. between respective BEE Locator blocks, as shown in FIG. 2). Additionally or alternatively, information allowing a direct comparison of BEE and SNR values in the left and right listening devices for use in the dynamic allocation of available donor bands to appropriate target bands can be exchanged between the left and right listening devices (e.g. between respective BEE Allocator blocks, as shown in FIG. 2). Additionally or alternatively, information allowing a direct comparison of other information, e.g. related to sound source localization, e.g. related to or including microphone signals or signals from sensors located locally in or at the left or right listening devices, respectively, e.g. sensors related to the local acoustic environment, e.g. howl, modulation, noise, etc. can be exchanged between the left and right listening devices (e.g. between the respective Localization, Source Extraction, Source enhancement, Additional HI processing blocks, as shown in FIG. 2). Although three different wireless links WL are shown in FIG. 2, the WL-indications are only intended to indicate the exchange of data, the physical exchange may or may not be performed via the same link. In an embodiment, the information related to the head and torso geometry of a user of the listening devices is omitted in the left and/or right listening devices. Alternatively such information is indeed stored in one or both instruments, or made available from a database accessible to the listening devices, e.g. via a wireless link (cf. medium Head and torso geometry in FIG. 2).

Further embodiments and modifications of a listening device and a bilateral listening system based on left and right listening devices as illustrated in FIG. 1 are further discussed in the following. Likewise, further embodiments and modifications of a binaural listening system as illustrated in FIG. 2 are further discussed in the following.

The better ear effect as discussed in the present application is illustrated in FIG. 3 by some simple examples of sound source configurations.

The four examples provide simplified visualizations of the calculations that lead to the estimation of which frequency regions that provide a BEE for a given source. The visualizations are based on three sets of HRTF's chosen from Gardner and Martin's KEMAR HRTF database [Gardner and Martin, 1994]. In order to keep the examples simple, the source spectra are flat (impulse sources), and the visualizations therefore neglect the impact of the source magnitude spectra, which would additionally occur in practice.

Figure 3A:
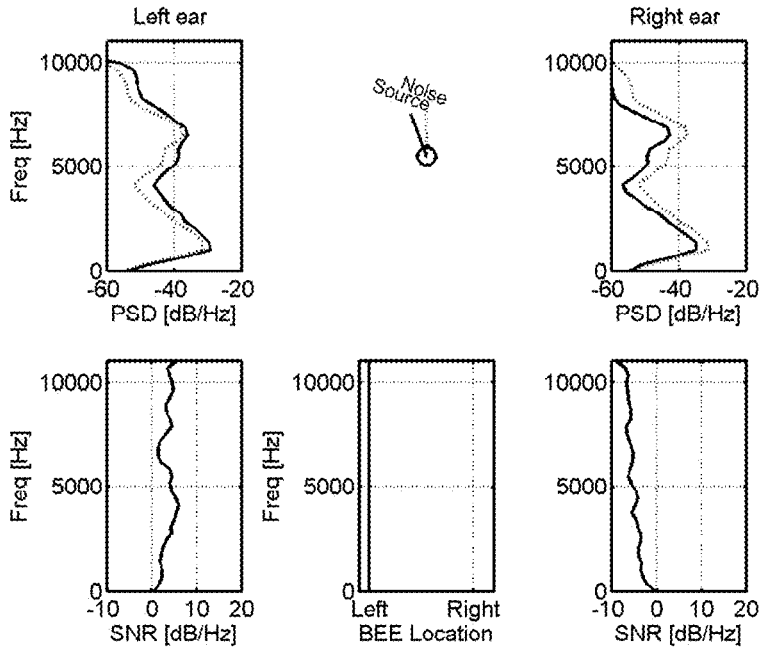
FIG. 3 shows four simple examples of sound source configurations and corresponding power density spectra of the left and right listening devices illustrating the better ear effect as discussed in the present application, FIG. 4 schematically illustrates a conversion of a signal in the time domain to the time-frequency domain, FIG. 4*a* illustrating a time dependent sound signal (amplitude versus time) and its sampling in an analogue to digital converter, FIG. 4*b* illustrating a resulting 'map' of time-frequency units after a Fourier transformation of the sampled signal.
Figure 3B:
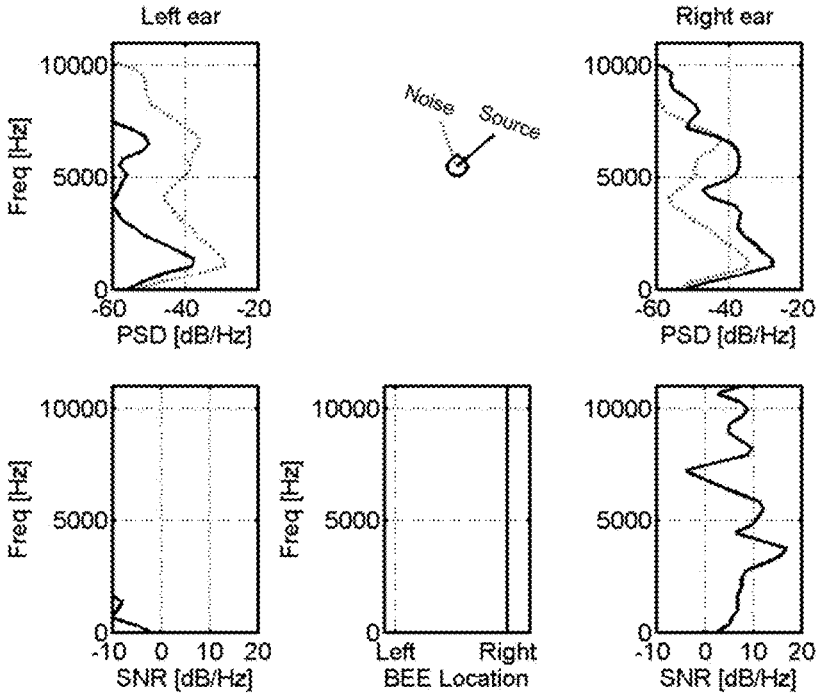
Figure 3C:
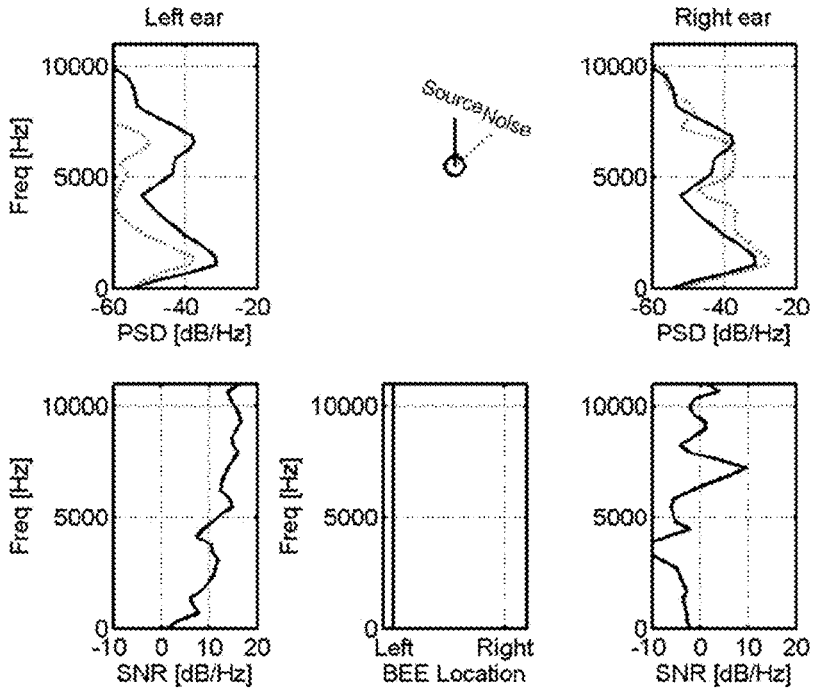
Figure 3D:
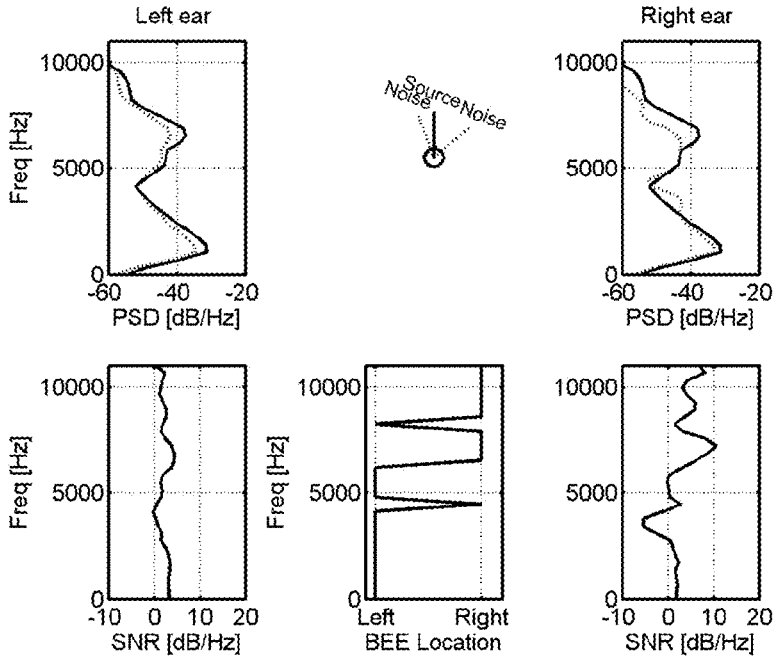

| | Example 1, FIG. 3a | Example 2, FIG. 3b | Example 3, FIG. 3c | Example 4, FIG. 3d |
|---|---|---|---|---|
| Target source | 20° to the left | 50° to the right | Front | Front |
| Noise source(s) | Front | 20° to the left | 50° to the right | 20° to the left 50° to the right |

Each example (1, 2, 3, 4) is contained in a single figure (FIG. 3*a*, 3*b*, 3*c*, 3*d*, respectively), the sources present and their location relative to each other is summarized in the above table. The upper middle panel of each of FIG. 3*a*-3*d* shows the spatial configuration of the source and noise(s) signals corresponding to the table above. The two outer (left and right) upper panels of each of FIG. 3*a*-3*d* show the Power Spectral Density (PSD) of the source signal and the noise signal(s) when they reach each ear (left ear PSD to the left, right ear PSD to the right). The outer (left and right) lower panels of each of FIG. 3*a*-3*d* (immediately below the respective PSD's) show the SNR for the respective ears. Finally, the middle lower panel of each of FIG. 3*a*-3*d* indicates the location (left/right) of the better ear effect (BEE, i.e. the ear having the better SNR) as a function of frequency (e.g. if SNR(right)>SNR(left) at a given frequency, the BEE is indicated in the right part of the middle lower panel, and vice versa). As it appears, the size of the BEE (difference in dB between the SNR curves of the left and right ears, respectively) for each of the different sound source configurations varies with frequency. In FIGS. 3*a*, 3*b* and 3*c* two sound sources are assumed to be present in the vicinity of the user, one comprising noise, the other a target sound. In FIG. 3*d*, three sound sources are assumed to be present in the vicinity of the user, two comprising noise, the other a target sound. In the sound source configuration of FIG. 3*a*, where a noise sound source is located in front of the user and the target sound source is located 20° to the left of the user's front direction, the BBE is constantly on the left ear. In the sound source configuration of FIG. 3*b*, where a noise sound source is located 20° to the left of the user's front direction and the target sound source is located 50° to the right of the user's front direction, the BBE is predominantly on the right ear. In the sound source configuration of FIG. 3*c*, where a noise sound source is located 50° to the right of the user's front direction and the target sound source is in front of the user, the BBE is predominantly on the left ear. In the sound source configuration of FIG. 3*d*, where two noise sound sources are located, respectively, 20° to the left and 50° to the right of the user's front direction, and where the target sound source is in front of the user, the BBE is predominantly on the left ear at the relatively lower frequencies (below 5 kHz) and predominantly on the right ear at the relatively higher frequencies (above 5 kHz), with deviations there from in narrow frequency ranges around 4.5 kHz and 8 kHz, respectively.

The examples use impulse sources, so basically the examples are just comparisons of the magnitude spectra of the measured HRTF's (and do not include the effect of spectral coloring, when an ordinary sound source is used, but the simplified examples nevertheless illustrate principles of the BEE utilized in embodiments of the present invention). The Power Spectral Density in comparison to the Short Time Fourier Transforms (STFT's) is used to smooth the magnitude spectra for ease of reading and understanding. In the last example where there are two noise sources, the two noise sources are attenuated 12 dB.

Figure 4A:
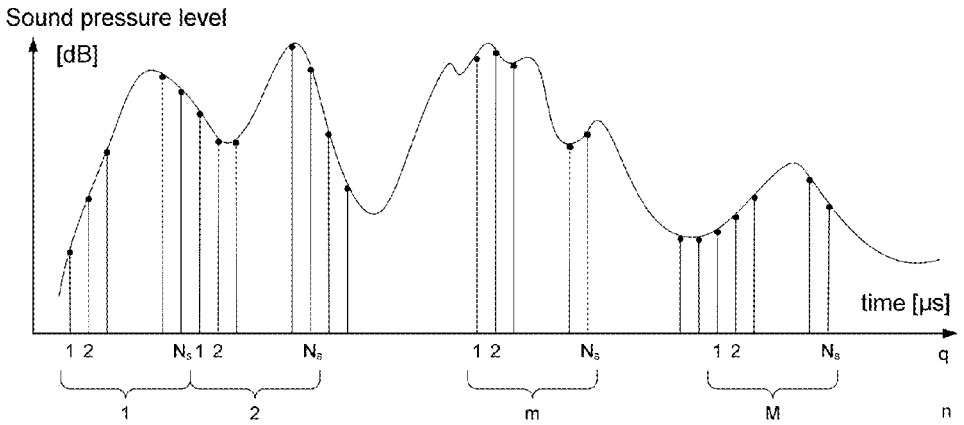
Figure 4B:
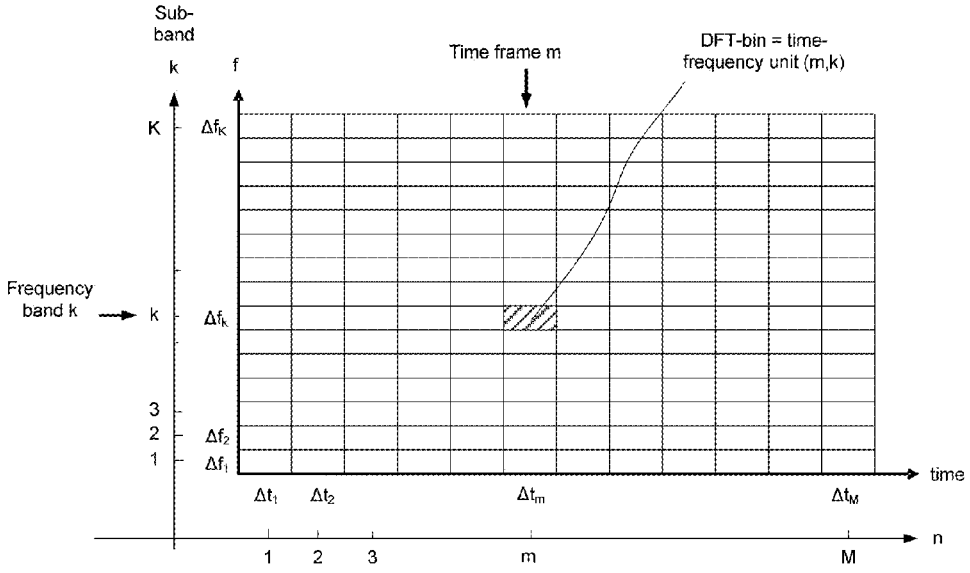

A conversion of a signal in the time domain to the time-frequency domain is schematically illustrated in FIG. 4 below. FIG. 4*a* illustrates a time dependent sound signal (amplitude versus time), its sampling in an analogue to digital converter and a grouping of time samples in frames, each comprising $N_s$ samples. FIG. 4*b* illustrates a resulting 'map' of time-frequency units after a Fourier transformation (e.g. a DFT) of the input signal of FIG. 4*a*, where a given time-frequency unit m, k corresponds to one DFT-bin and comprises a complex value of the signal (magnitude and phase) in a given time frame m and frequency band k. In the following, a given frequency band is assumed to contain one (generally complex) value of the signal in each time frame. It may alternatively comprise more than one value. The terms 'frequency range' and 'frequency band' are used interchangeably in the present disclosure. A frequency range may comprise one or more frequency bands.

1. Processing steps 1.1. Prerequisites 1.1.1. Short Time Fourier Transformation (STFT)

Given a sampled signal x[n] the Short Time Fourier Transform (STFT) is approximated with the periodic Discrete Fourier Transform (DFT). The STFT obtained with a window function w[m] that balances the trade-off between time-resolution and frequency-resolution via its shape and length. The size of the DFT K, specifies the sampling of the frequency axis, with the rate of FS/K, where FS is the system sample rate:

$$X[n,k]=\sum_{m=-\infty}^{\infty}x[m]w[m-n]e^{-\frac{j2\pi k}{K}},\ k=0,1,\ldots,\frac{K}{2}.$$

The STFT is sampled in time and frequency, and each combination of n and k specifies a single time-frequency unit. For a fixed n, the range of k's corresponds to a spectrum. For a fixed $k^k$, the range of n's corresponds to a time-domain signal restricted to the frequency range of the k'th channel. For additional details on the choice of parameters etc in STFTS's consult Goodwin's recent survey [Goodwin, 2008].

1.1.2. Transposition Engine

The BEE is provided via a frequency transposition engine that is capable of individually combining magnitude and phase of one or more donor bands with magnitude and phase, respectively, of a target band to provide a resulting magnitude and phase, respectively, of the target band. Such general transposition scheme can be expressed as $$MAG(T\text{-}FB_{kt,res})=\mathrm{SUM}[\alpha_{kd}MAG(S\text{-}FB_{kd})]+\alpha_{kt}MAG(T\text{-}FB_{kt,orig})$$

$$PHA(T\text{-}FB_{kt,res})=\mathrm{SUM}[\beta_{kd}PHA(S\text{-}FB_{kd})]+\beta_{kt}PHA(T\text{-}FB_{kt,orig}),$$

where kd is an index for the available donor frequency bands (cf. D-FB1, D-FB2, . . . , D-FBq in FIG. 5), and where kt is an index for the available target frequency bands (cf. T-FB1, T-FB2, . . . , T-FBp in FIG. 5), and where the SUM is made over the available kd's and where α and β are constants (e.g. between 0 and 1).

The frequency transposition is e.g. adapted to provide that transposing the donor frequency range to the target frequency range:

- Includes transposition by substitution (replacement), thus discarding the original signal in the target frequency range;
- Includes transposition by mixing, e.g. adding the transposed signal to the original signal in the target frequency range.

Further, substituting or mixing the magnitude and/or phase of the target frequency range with the magnitude and/or phase of the donor frequency range:

- Includes the combination of magnitude from one donor frequency range with the phase from another donor frequency range (including the donor range);
- Includes the combination of magnitude from a set of donor frequency ranges with the phase from another set of donor frequency ranges (including the donor range).

In a filterbank based on the STFT, cf. [Goodwin, 2008] each time-frequency unit affected by transposition becomes $$Y_s[n,k]=|X_s[n,k_m]|e^{j\angle X_s[n,k_p]}e^{\frac{2\pi j(k-k_p)}{K}},$$

where $j=\sqrt{-1}$ is the complex constant, $Y_s[n,k]$ the complex spectral value after transposition of the magnitude $|X_s[n,k_m]|$ $|X_s[n,k_m]|$ from donor frequency band $k_m$, phase $\angle X_s[n,k_p]^{\angle X_s[n,k_p]}$ from donor frequency band $k_p{}^{k_p}$, and finally $$e^{\frac{2\pi j(k-k_p)}{K}}$$

the necessary circular frequency shift of the phase [Proakis and Manolakis, 1996]. However, other transposition designs may be used as well.

Figure 5:
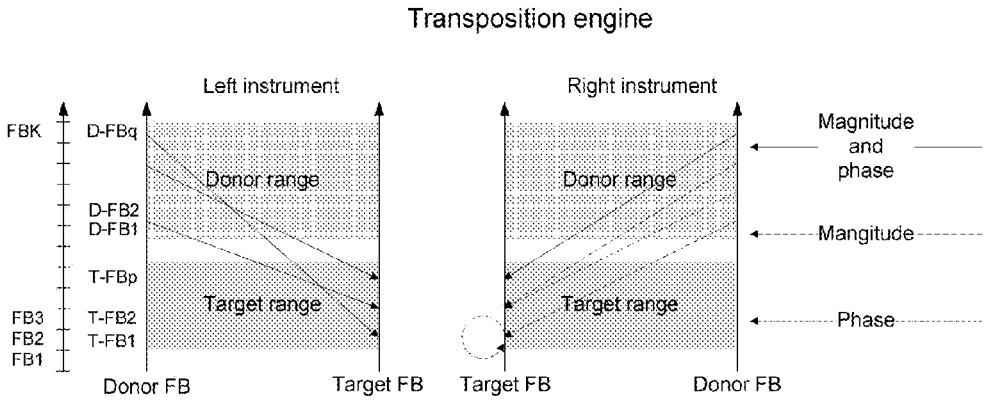
FIG. 5 shows a few simple examples of configurations of the transposition engine according to the present disclosure.

FIG. 5 illustrates an example of the effect of the transposition process (the (Transposition engine in FIG. 1, 2). The vertical axes have low frequencies in the bottom and high frequencies at the top, corresponding to frequency bands FB1, FB2, . . . , FBi, . . . , FBK, increasing index i corresponding to increasing frequency. The left instrument transpose three donor bands (D-FBi) from the donor range (comprising donor frequency bands D-FB1, D-FB2, . . . , D-FBq) to the target range (comprising target frequency bands T-FB1, T-FB2, . . . , T-FBp), and show that it is not necessary to maintain the natural frequency ordering of the bands. The right instrument shows a configuration where the highest target band receives both magnitude and phase from the same do nor band. The next lower target band receives magnitude from one donor frequency band the phase from another (lower lying) donor frequency band. Finally the lowest frequency band only substitutes its magnitude with the magnitude from the donor band, while the phase of the target band is kept.

FIG. 5 provides a few simple examples of configurations of the transposition engine. Other transposition strategies may be implemented by the transposition engine. As the BEE occurs mainly at relatively higher frequencies, and is mainly needed at relatively lower frequencies, the examples throughout the document have the donor frequency range above the target frequency range. This is, however, not a necessary constraint.

1.1.3. Source Estimation and Source Separation

For multiple simultaneous signals the following assume that one signal (number i) is chosen as the target, and that the remaining signals are considered as noise as a whole. Obviously this requires that the present source signals and noise sources are already separated by means of e.g. blind source separation, cf. e.g. [Bell and Sejnowski, 1995], [Jourjine et al., 2000], [Roweis, 2001], [Pedersen et al., 2008], microphone array techniques, cf. e.g. chapter 7 in [Schaub, 2008], or combinations hereof, cf. e.g. [Pedersen et al., 2006], [Boldt et al., 2008].

Moreover, it requires an estimate of the number of present sources, although the noise term may function as a container for all signal parts that cannot be attributed to an identified source. Moreover, the described calculations are required for all identified sources, although there will be a great degree of overlap and shared calculations.

Full Bandwidth Source Signal Estimation

Microphone array techniques provide an example of full source signal estimation in source separation. Essentially the microphone array techniques separate the input into full bandwidth signals that originate from various directions. Thus if the signal originating from a direction is dominated by a single source, this technique provides a representation of that source signal.

Another example of full bandwidth source signal estimation is the application of blind de-convolution of full bandwidth microphone signals demonstrated by Bell and Sejnowski [Bell et al., 1995].

Partial Source Signal Estimation

However, the separation does not have to provide the full bandwidth signal. The key finding of Jourjine et al. was that when two source signals are analyzed in STFT domain, the time-frequency units rarely overlap [Jourjine et al., 2000]. [Roweis, 2001] used this finding to separate two speakers from a single microphone recording, by applying individual template binary masks to the STFT of the single microphone signal. The binary mask [Wang, 2005] is an assignment of time-frequency units to a given source, it is binary as a single time-frequency unit either belongs to the source or not depending on whether it is the loudest source in that unit. Apart from some noise artifacts, the result preserving only time-frequency units belonging to a given source results in highly intelligible speech signals. In fact this corresponds to a full bandwidth signal that only contains the time-frequency units associated with the source.

Another application of the binary masks is with directional microphones (possibly achieved with the microphone array techniques or beamforming mentioned above. If one microphone is more sensitive to one direction than to another, then the time-frequency units where the first microphone are louder than the second, indicates that the sound arrives from the direction where the first microphone is more sensitive.

In the presence of inter-instrument communication it is also possible to apply microphone array techniques that utilize microphones in both instruments, cf. e.g. EP1699261A1 or US 2004/0175008 A1.

The present invention does not necessarily require a full separation of the signal, in the sense that a perfect reconstruction of a source's contribution to the signal that a given microphone or artificial microphone, sometimes used in beamforming and microphone array techniques, receives. In practice the partial source signal estimation may take place as a booking that merely assign time-frequency units to the identified sources or the noise.

1.1.4. Running Calculation of Local SNR

Given a target signal (x) and a noise (v), the global signal-to-noise ratio is $$SNR = 10\log\frac{\sum_n (x[n])^2}{\sum_n (v[n])^2}.$$

However, this value does not reflect the spectral and temporal changes of the signals, instead the SNR in a specific time interval and frequency interval is required.

A SNR measure based on the Short Time Fourier Transform of $x[n]^{x[n]}$ and v(n), denoted X[n,k] and N[n,k], respectively, fulfils the requirement $$SNR[n,k] = 10\log\frac{X[n,k]^2}{N[n,k]^2}.$$

With this equation the SNR measure is confined to a specific time instant n and frequency k and thus local.

Taking the Present Sources into Account

From the local SNR equation given above it is trivial to derive the equation that provides the local ratio between energy of the selected source s to the remaining sources s' and the noise:

$$SNR_s[n,k] = 10\log\frac{|X_s[n,k]|^2}{\left(|N[n,k]| + \sum_{s'\neq s} |X_{s'}[n,k]|\right)^2}.$$

1.1.5. Head Related Transfer Functions (HRTF)

The head related transfer function (HRTF) is the Fourier Transform of the head related impulse response (HRIR). Both characterize the transformation that a sound undergoes when travelling from its origin to the tympanic membrane.

Defining HRTF for the two ears (Left and Right) as a function of the horizontal angle of incidence of the common midpoint θ and the deviation from the horizontal plane □, leads to $HRTF_l(f,\theta,\phi)$ and $HRTF_r(f,\theta,\phi)$. The ITD and ILD (as seen from left ear) can then be expressed as $$ITD(f,\theta,\phi) = \frac{2\pi}{f}\cdot\angle\left\{\frac{HRTF_l(f,\theta,\phi)}{HRTF_r(f,\theta,\phi,)}\right\}$$

and $$ILD(f,\theta,\phi) = 20\log\left|\frac{HRTF_l(f,\theta,\phi)}{HRTF_r(f,\theta,\phi,)}\right|,$$

where ∠{x} and |x| denotes phase and magnitude of the complex number x, respectively. Furthermore, notice that the common midpoint results in that the incidence angles in the two hearing instruments are equivalent.

1.1.6. BEE Estimate with Direct Comparison

Given the separated source signals in the time-frequency domain (after the application of the STFT), i.e. $X_s^l[n,k]$ and $X_s^r[n,k]$ (although a binary mask associated with the source, or an estimate of the magnitude spectrum of that signal will be sufficient), and an estimate of the angle of incidence in the horizontal plane, the hearing instrument compares the local SNR's across the ears to estimate the frequency bands for which this source have beneficial SNR differences. The estimation takes place for one or more, such as a majority or all present identified sound sources.

The BEE is the difference between the source specific SNR at the two ears $$BEE_s^l[n,k]=SNR_s^l[n,k]-SNR_s^r[n,k] \wedge SNR_s^l[n,k]>\tau_{SNR})$$

$$BEE_s^r[n,k]=SNR_s^r[n,k]-SNR_s^l[n,k] \wedge SNR_s^r[n,k]>\tau_{SNR})$$

1.1.7. BEE Estimates with Indirect Comparison

Given the separated source signals in the time-frequency domain (after the application of the STFT), i.e. $X_s^l[n,k]$ (although a binary mask associated with the source, or an estimate of the magnitude spectrum of that signal will be sufficient), an estimate of the angle of incidence in the horizontal plane $\theta_s$, and an estimate of the angle of incidence in the vertical plane $\phi_s^{\Phi_s}$ the instrument estimates the level of the sources in the opposite ear via the HRTF and does an SNR calculation using these magnitude spectra. For each source s $$|X_s^r[n,k]| = |X_s^l[n,k]| \cdot \left|\frac{HRTF_r(k,\theta_s,\phi_s)}{HRTF_l(k,\theta_s,\phi_s)}\right| = \frac{|X_s^l[n,k]|}{ILD[k,\theta_s,\phi_s]},$$

where $ILD[k,\theta_s,\phi_s]$ is a discrete sampling of the continuous $ILD(f,\theta_s,\phi_s)$ function. Accordingly the SNR becomes $$SNR_s^r[n,k] = 10\log\frac{\left(\frac{X_s^l[n,k]}{ILD(k,\theta_s,\phi_s)}\right)^2}{\left(\frac{|N^r[n,k]|}{ILD(k,\theta_N,\phi_N)} + \sum_{s'\neq s}\frac{X_{s'}^l[n,k]}{ILD(k,\theta_{s'},\phi_{s'})}\right)^2}$$

where s is the currently selected source, and $s'\neq s^{s'\neq s}$ denotes all other present sources.

1.2. BEE Locator

The present invention describes two different approaches to estimating the BEE. One method do not require the hearing aids (assuming one for each ear) to exchange information about the sources. Furthermore, the approach also works for a monaural fit. The other approach utilizes communication in a binaural fit to exchange the relevant information.

1.2.1. Monaural and Bilateral BEE Estimation

Given that the hearing instrument can separate the sources—at least assign a binary mask, and estimate the angle of incidence in the horizontal plane, the hearing instrument utilizes the stored individual HRTF database to estimate the frequency bands where this source should have beneficial BEE. The estimation takes place for one or more, such as a majority or all present identified sound sources. The selection in time frame n for a given source s is as follows: select bands (indexed by k) that fulfill $$SNR_s[n,k]>\tau_{SNR} \wedge ILD[k,\theta_s,\phi_s]\tau_{ILD}$$

This results in a set of donor frequency bands $DONOR_s(n)$, where the BEE associated with source s is useful, where $T_{SNR}$ and $T_{ILD}$ are threshold values for the signal to noise ratios and interaural level differences, respectively. Preferably, the threshold values $T_{SNR}$ and $T_{ILD}$ are constant over frequency. They may, however, be frequency dependent.

The hearing instrument wearer's individual left and right HRTFs are preferably mapped (in advance of normal operation of the hearing instrument) and stored in a database of the hearing instrument (or at least in a memory accessible to the hearing instrument). In an embodiment, specific clinical measures to establish the individual or group values of $T_{SNR}$ and $T_{ILD}$ are performed and the results stored in the hearing instrument in advance of its normal operation.

Since the calculation does not involve any exchange of information between the two hearing instruments, the approach may be used for bilateral fits (i.e. two hearing aids without inter-instrument communication) and monaural fits (one hearing aid).

Combining the separated source signal with the previously measured ILD, the instrument is capable of estimating the magnitude of each source at the other instrument. From that estimate it is possible for a set of bilaterally operating hearing instruments to approximate the binaural BEE estimation described in the next section without communication between them.

1.2.2. Binaural BEE Estimation

The selection in the left instrument in time frame n for source s is as follows: Select the set of bands (indexed by k) $DONOR_s^l[n]$ that fulfills $$BEE_s^l[n,k]>\tau_{BEE}.$$

Similarly for the right instrument, select the set of frequency bands $DONOR_s^r[n]$ that fulfills $$BEE_s^r[n,k]>\tau_{BEE}.$$

Thus the measurement of the individual left and right HRTFs may be omitted at the expense of inter-instrument communication. As for the monaural and bilateral estimation, $T_{BEE}^{\tau_{BEE}}$ is a threshold parameter. Preferably, the threshold value $T_{BEE}$ is constant over frequency and location of the listening device (left, right). They may, however, be different from left to right and/or frequency dependent. In an embodiment, specific clinical measures in order to establish individual or group-specific values are performed in advance of normal operation of the hearing instrument(s).

1.2.3. Online Learning of the HRTF

With a binaural fit, it is possible to learn the HRTF's from the sources over a given time. When the HRTF's have been learned it is possible to switch to the bilateral BEE estimation to minimize the inter-instrument communication. With this approach it is possible to skip the measurement of the HRTF during hearing instrument fitting, and minimize the power consumption from inter-instrument communication. Whenever the set of hearing instruments have found that the difference in chosen frequency bands is sufficiently small between the binaural and bilateral estimation for a given spatial location, the instrument can rely on the bilateral estimation method for that spatial location.

1.3. BEE Provider

Although the BEE Provider is placed after the BEE Allocator on the flowcharts (cf. FIGS. 1 and 2), the invention is more easily described by going through the BEE Provider first. The transposition moves the donor frequency range to the target frequency range.

Figure 6A:
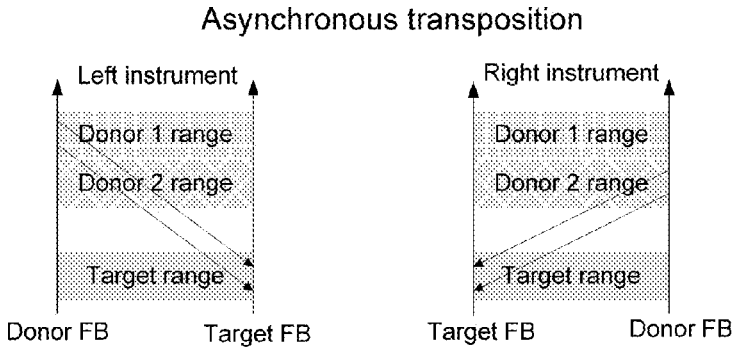
FIG. 6 shows two examples of configurations of the transposition engine according to the present disclosure, FIG. 6*a* illustrating asynchronous transposition and FIG. 6*b* illustrating synchronous transposition.
Figure 6B:
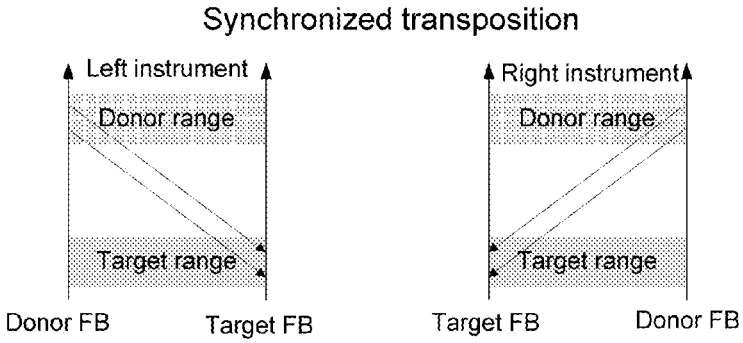
Figure 7:
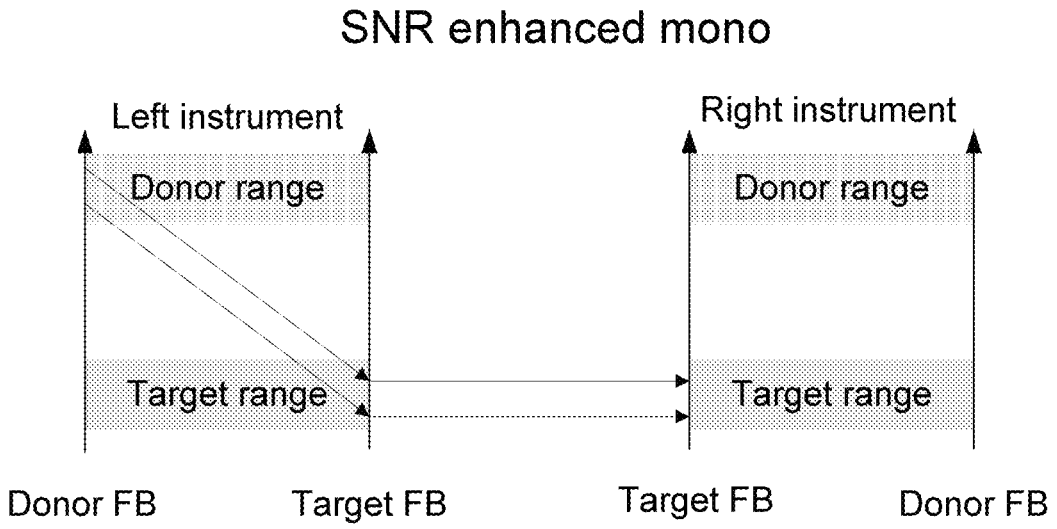
FIG. 7 shows a further example of a configuration of the transposition engine according to the present disclosure, wherein the right instrument receives the transposed signal from the left instrument and (optionally) scales this according to the desired ILD.
Figure 8:
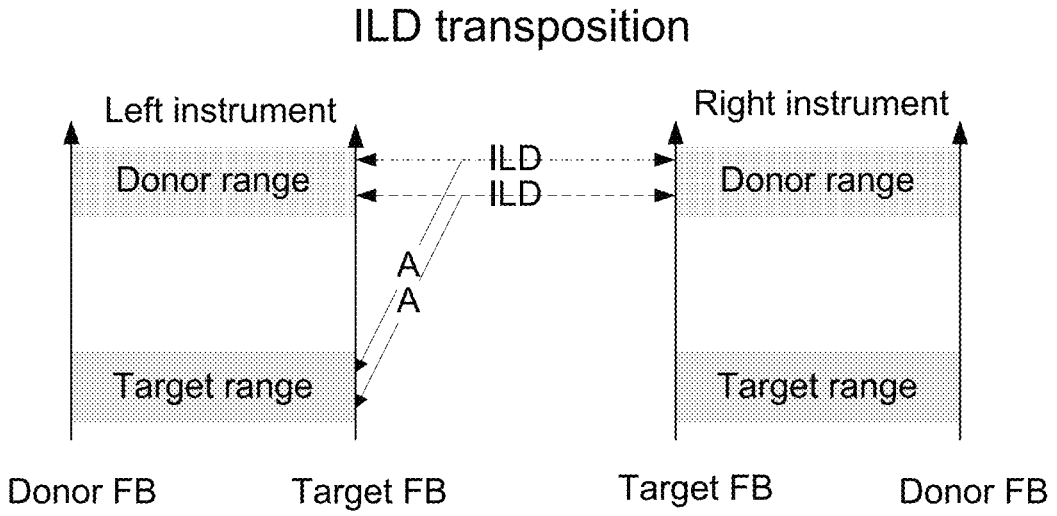
FIG. 8 shows a further example of a configuration of the transposition engine according to the present disclosure, wherein the instruments estimate the ILD in the donor range and applies a similar gain to the target range.

The following subsections describe four different modes of operation. FIG. 6 illustrates two examples of the effect of the transposition process, FIG. 6*a* a so-called asynchronous transposition and FIG. 6*b* a so-called synchronous transposition. FIG. 7 illustrates a so-called enhanced mono mode and FIG. 8 illustrates an ILD-transposition mode. Each of FIG. 6*a*, 6*b*, 7, 8 illustrates one or more donor ranges and a target range for a left and a right hearing instrument, each graph for a left or right instrument having a donor frequency axis and a target frequency axis, the arrow on the frequency axes indicating a direction of increasing frequency.

1.3.1. Asynchronous Transposition

In asynchronous operation the hearing instrument configures the transposition independently, such that the same frequency band may be used as target for one source in one instrument, and another source in the other instrument, and consequently the two sources will be perceived as more prominent in one ear each.

FIG. 6*a* shows an example of asynchronous transposition. The left instrument transposes the frequency range where source 1 (corresponding to Donor 1 range in FIG. 6*a*) has beneficial BEE to the target range while the right instrument transposes the frequency range where source 2 (Donor 2 range) has beneficial BEE to the same target range.

1.3.2. Synchronized Transposition

In synchronized transposition the hearing instruments share donor and target configuration, such that the frequency in the instrument with the beneficial BEE and the signal in the other instrument is transposed to the same frequency range. Thus frequency range in both ears are there is used for that source. Nevertheless, it may happen that two sources are placed symmetrically around the wearer, such that their ILD's are symmetric as well. In this case, the synchronized transposition may use the same frequency range for multiple sources.

The synchronization may be achieved by communication between the hearing instruments, or via the bilateral approximation to binaural BEE estimation, where the hearing instrument can estimate what the other hearing instrument will do without the need for communication between them.

1.3.3. SNR Enhanced Mono

In some cases it may be beneficial to enhance the signal at the ear with the bad BEE, such that the hearing instrument with the beneficial BEE shares that signal with the instrument with the poor BEE. The physical BEE may be reduced by choice, however, both ears will receive the signal that was estimated from the most positive source specific SNR. As shown in FIG. 7, the right instrument receives the transposed signal from the left instrument and (optionally) scales this according to the desired ILD.

1.3.4. ILD Transposition

Whenever the donor and target frequency band is dominated by the same source, it may improve the sound quality if the ILD is transposed. In the example of FIG. 8, an ILD of a (relatively higher frequency) donor frequency band is determined (symbolized by dashed arrows ILD in FIG. 8) and applied to a (relatively lower frequency) target frequency band (symbolized by arrows A in FIG. 8). The ILD is e.g. determined in one of the instruments as the ratio of the magnitude of the signals from the respective hearing instruments in the frequency band in question (thus only a transfer of the magnitude of the signal in the frequency range in question from one instrument to the other is needed). Thus even though the unprocessed sound had almost the same level in both ears at the target frequencies, this mode amplifies the separated sounds in target frequency ranges on the side where the BEE occurred at the donor frequency ranges. The ILD may be e.g. applied in both instruments (only shown in FIG. 8 to be applied to the target range of the left hearing instrument).

1.4. BEE Allocator

Having found the frequency bands with beneficial BEE, the next step aims at finding the frequency bands that contribute poorly to the wearer's current spatial perception and speech intelligibility such that their information may be substituted with the information with good BEE. Those bands are referred to as the target frequency bands in the following.

Having estimated the target ranges, as well as the donor ranges for the different sources, the next steps involve the allocation of the identified target ranges. How this takes place is described after the description of the estimation of the target range.

1.4.1. Estimating the Target Range

In the following, a selection among the (potential) target bands that have been determined from the users' hearing ability (e.g. based on an audiogram and/or on results of a test of a user's sound level resolution) is performed. A potential target band may e.g. be determined as a frequency band where a user's hearing ability is above a predefined level (e.g. based on an audiogram for the user). A potential target band may, however, alternatively or additionally, be determined as a frequency band for which a user has the ability to correctly decide on which ear the level is the larger, when sounds of different levels are played simultaneously to the user's left and right ears. Preferably a predefined difference in level of the two sounds used. Further, a corresponding test that may influence the choice of potential frequency bands for a user could be a test wherein the user's ability to correctly sense a difference in phase, when sounds (in a given frequency band) of different phase are played simultaneously to the user's left and right ears, is tested.

Monaural and Bilateral BEE Allocation for Asynchronous Transposition

In the monaural and bilateral BEE allocation the hearing instrument(s) do not have direct access to the BEE estimate, although it may be estimated from the combination of the separated sources and the knowledge of the individual HRTF's.

In the asynchronous transposition the instrument only needs to estimate the bands where there is not a beneficial BEE and SNR. It does not need to estimate whether that band has a beneficial BEE in the other instrument/ear. Therefore target bands fulfill $$\mathrm{BEE}_s[n,k]>\tau_{BEE} \wedge \mathrm{SNR}_s[n,k]<\tau_{SNR}$$

for all sources s using the indirect comparison.

The selection of target bands can also happen through the monaural SNR measure, by selecting the frequency bands that don't have beneficial SNR or ILD for all sources s $$\mathrm{SNR}_s[n,k]<\tau_{SNR} \wedge \mathrm{ILD}[k,\theta_s,\phi_s]<\tau_{ILD}$$

Monaural and Bilateral BEE Allocation for Synchronized Transposition

For synchronized transposition the target frequency bands are the frequency bands that don't have beneficial BEE (via the indirect comparison) in either instrument and don't have beneficial SNR in either instrument for any source s $$|\mathrm{BEE}_s[n,k]|<\tau_{BEE} \wedge \mathrm{SNR}_s^l[n,k]<\tau_{SNR} \wedge \mathrm{SNR}_s^r[n,k]$$
$$\tau_{SNR}$$

Binaural BEE Allocation for Asynchronous Transposition

For asynchronous transposition the binaural estimation of target frequency bands involve the direct comparison of left and right instruments BEE and SNR values.

$$\mathrm{BEE}_s^l[n,k]<\tau_{BEE} \wedge \mathrm{SNR}_s^l[n,k]<\tau_{SNR}$$

or alternatively $$\mathrm{BEE}_s^r[n,k]<\tau_{BEE} \wedge \mathrm{SNR}_s^r[n,k]<\tau_{SNR}$$

The (target) frequency bands whose SNR difference do not exceed the BEE threshold may be substituted with the contents of the (donor) frequency bands where a beneficial BEE occurs. As the two hearing instruments are not operating in synchronous mode the two instruments do not coordinate their targets and donors, thus a frequency band with a large negative BEE estimate (that means that there is a beneficial BEE in the other instrument) can be substituted as well.

Binaural BEE Allocation for Synchronized Transposition $$|\mathrm{BEE}_s^r[n,k]|<\tau_{BEE} \wedge \mathrm{SNR}_s^l[n,k]<\tau_{SNR} \wedge \mathrm{SNR}_s^r[n,k]<\tau_{SNR}$$

In synchronous mode the two hearing instruments share donor and target frequency bands. Consequently the available target bands are the bands that don't have beneficial BEE or SNR in any of the instruments.

1.4.2. Dividing the Target Range

The following describe two different objectives for the distribution of the available target frequency ranges to the available donor frequency ranges.

Focus BEE—Single Source BEE Enhancement

Figure 9:
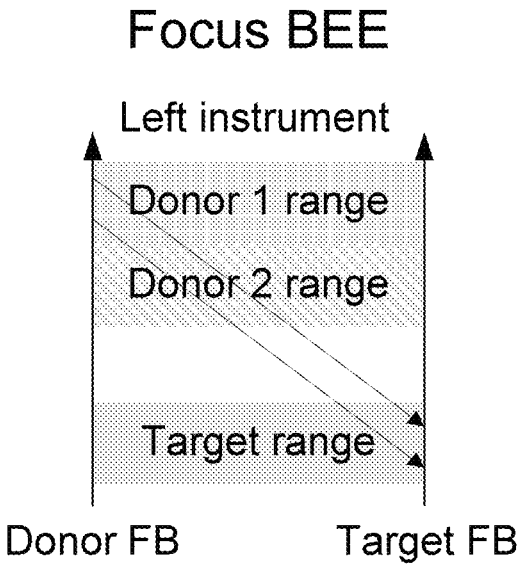
FIG. 9 illustrates a further example of a configuration of the transposition engine according to the present disclosure, wherein an instrument only provides the BEE for one source (the other source being not transposed)

If only a single source is BEE enhanced, all available frequency bands may be filled up with content with beneficial information. The aim can be formulated as maximizing the overall spatial contrast between a single source (a speaker) and one or more other sources (being other speakers and noise sources). An example of this focusing strategy is illustrated in FIG. 9, where two sources occupying Donor 1 range and Donor 2 range, respectively, are available, but only two donor bands from the Donor 1 range are transposed to two target bands in the Target range.

Various strategies for (automatically) selecting a single source (target signal) can be applied, e.g. the signal that contains speech having the highest energy content, e.g. when averaged over a predefined time period, e.g. ≤5 s. Alternatively or additionally, a source coming approximately from the front of the user may be selected. Alternatively or additionally, a source may selected by a user via a user interface, e.g. a remote control.

The strategy can also be called "focus BEE", due to the fact that it provides as much BEE for a single object as possible, enabling the wearer to focus solely on that sound.

Scanning BEE—Multi Source BEE Enhancement

If the listener has sufficient residual capabilities, the hearing instrument may try to divide the available frequency bands between a number of sources. The aim can be formulated as maximizing the number of independently received spatial contrasts, i.e., provide "clear" spatial information for as many of the current sound sources as the individual wearer can cope.

Figure 10:
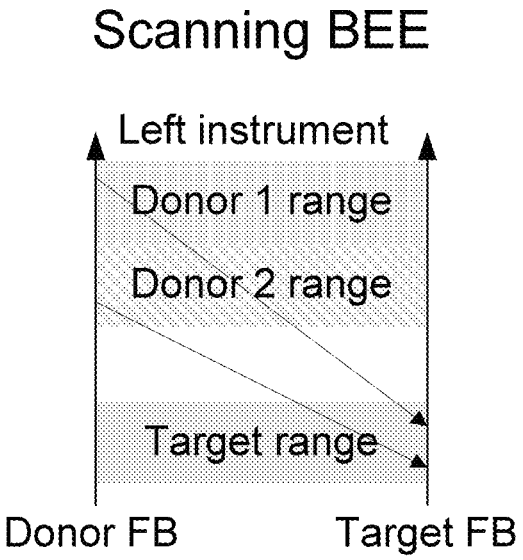
FIG. 10 illustrates a further example of a configuration of the transposition engine according to the present disclosure, termed Scanning BEE mode wherein an instrument splits the target range and provides (some) BEE for both sources, FIG. 11 schematically illustrates embodiments of a listening device for implementing methods and ideas of the present disclosure.

The second mode is called "scanning BEE", due to the fact that it provides BEE for as many objects as possible, depending on the wearer, enabling the wearer to scan/track multiple sources. This operation mode is likely to require better residual spatial skills than for the single source BEE enhancement. The scanning BEE mode is illustrated in FIG. 10, where two sources occupying Donor 1 range and Donor 2 range, respectively, are available, and one donor band (Donor FB) from each of the Donor 1 range and Donor 2 range are transposed to two different target bands (Target FB) in the Target range.

2. A Listening Device and a Listening System 2.1. A Listening Device

FIG. 11 schematically illustrates embodiments of a listening device for implementing methods and ideas of the present disclosure.

Figure 11A:
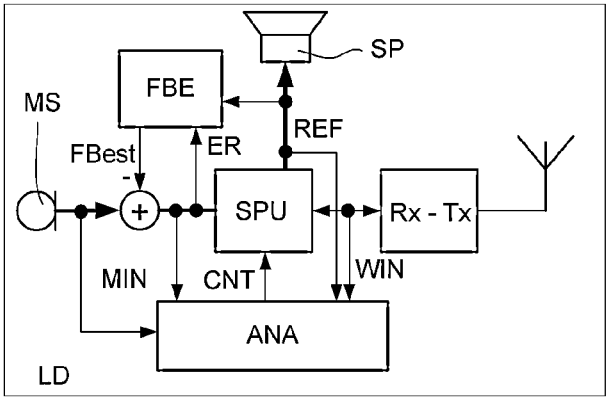

FIG. 11*a* shows an embodiment of a listening device (LD), e.g. a hearing instrument, comprising a forward path from an input transducer (MS) to an output transducer (SP), the forward path comprising a processing unit (SPU) for processing (e.g. applying a frequency dependent gain to) an input signal MIN picked up by the input transducer (here microphone system MS), or a signal derived therefrom, and providing an enhanced signal REF to the output transducer (here speaker SP). The forward path from the input transducer to the output transducer (here comprising SUM-unit '+' and signal processing unit SPU) is indicated with a bold line. The listening device (optionally) comprises a feedback cancellation system (for reducing or cancelling acoustic feedback from an 'external' feedback path from the output transducer to the input transducer of the listening device) comprising a feedback estimation unit (FBE) for estimating the feedback path and SUM unit ('+') for subtracting the feedback estimate FBest from the input signal MIN, thereby ideally cancelling the part of the input signal that is caused by feedback. The resulting feedback corrected input signal ER is further processed by the signal processing unit (SPU). The processed output signal from the signal processing unit, termed the reference signal REF, is fed to the output transducer (SP) for presentation to a user. An analysis unit (ANA) receives signals from the forward path (here input signal MIN, feedback corrected input signal ER, reference signal REF, and wirelessly received input signal WIN). The analysis unit (ANA) provides a control signal CNT to the signal processing unit (SPU) for controlling or influencing the processing in the forward path. The algorithms for processing an audio signal are executed fully or partially in the signal processing unit (SPU) and the analysis unit (ANA). The input transducer (MS) is representative of a microphone system comprising a number of microphones, the microphone system allowing to modify the characteristic of the system in one or more spatial directions (e.g. to focus the sensitivity in a forward direction of a user (attenuate signals from a rear direction of the user)). The input transducer may comprise a directional algorithm allowing the separation of one or more sound sources from the sound field. Such directional algorithm may alternatively be implemented in the signal processing unit. The input transducer may further comprise an analogue to digital conversion unit for sampling an analogue input signal and provide a digitized input signal. The input transducer may further comprise a time to time-frequency conversion unit, e.g. an analysis filter bank, for providing the input signal in a number of frequency bands allowing a separate processing of the signal in different frequency bands. Similarly, the output transducer may comprise a digital to analogue conversion unit and/or a time-frequency to time conversion unit, e.g. a synthesis filter bank, for generating a time domain (output) signal from a number of frequency band signals. The listening device can be adapted to be able to process information relating to the better ear effect, either derived solely from local information of the listening device itself (cf. FIG. 1) or derived partially from data received from another device via the wireless interface (antenna, transceiver Rx-Tx and signal WIN), whereby a binaural listening system comprising two listening devices located at left and right ears of a use can be implemented (cf. FIG. 2). Other information than information related to the BEE may be exchanged via the wireless interface, e.g. commands and status signals and/or audio signals (in full or in part, e.g. one or more frequency bands of an audio signal). Information related the BEE may e.g. be signal to noise (SNR) measures, interaural level differences (ILD), donor frequency bands, etc.

Figure 11B:
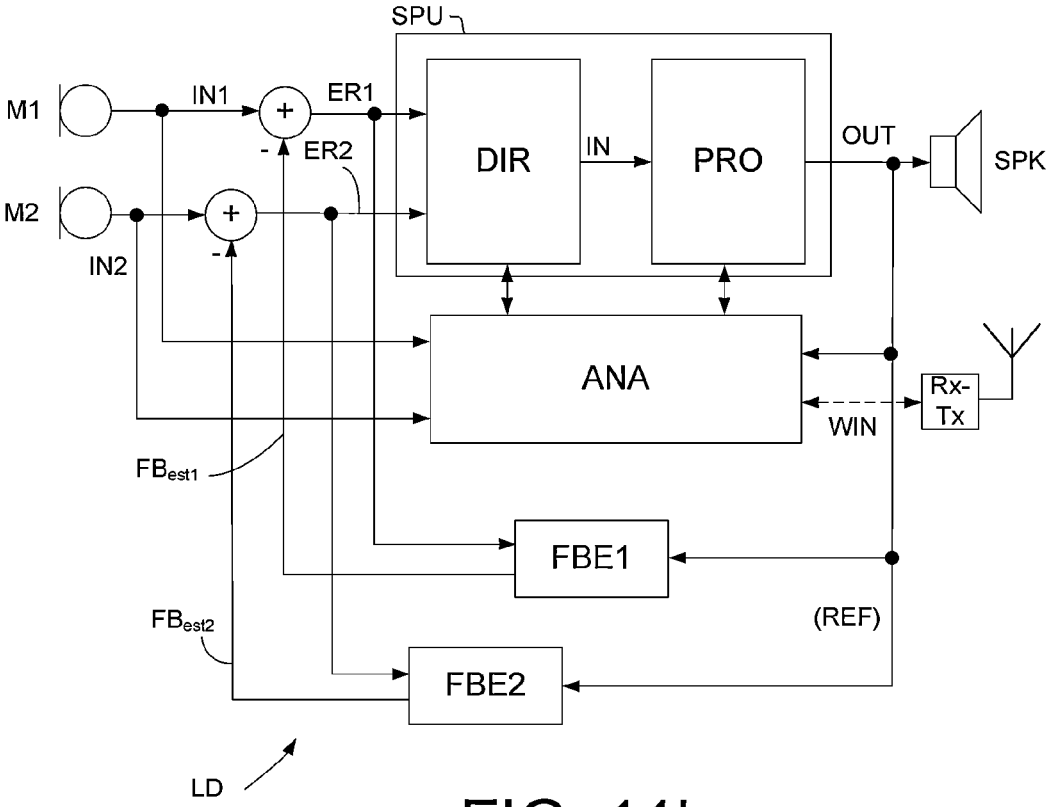

FIG. 11*b* shows another embodiment of a listening device (LD) for implementing methods and ideas of the present disclosure. The embodiment of a listening device (LD) of FIG. 11*b* is similar to the one illustrated in FIG. 11*a*. In the embodiment of FIG. 11*b* the input transducer comprises a microphone system comprising two microphones (M1, M2)

providing input microphone signals IN1, IN2 and a directional algorithm (DIR) providing a weighted combination of the two input microphone signals in the form of directional signal IN, which is fed to processing block (PRO) for further processing, e.g. applying a frequency dependent gain to the input signal and providing a processed output signal OUT, which is fed to the speaker unit (SPK). Units DIR and PRO correspond to signal processing unit (SPU) of the embodiment of FIG. 11*a*. The embodiment of a listening device (LD) of FIG. 11*b* comprises two feedback estimation paths, one for each of the feedback paths from speaker SPK to microphones M1 and M2, respectively. A feedback estimate ($FB_{est1}$, $FB_{est2}$) for each feedback path is subtracted from the respective input signals IN1, IN2 from microphones (M1, M2) in respective subtraction units ('+'). The outputs of the subtraction units ER1, ER2 representing respective feedback corrected input signals are fed to the signal processing unit (SPU), here to the directional unit (DIR). Each feedback estimation path comprises a feedback estimation unit (FBE1, FBE2), e.g. comprising an adaptive filter for filtering an input signal (OUT (REF)) and providing a filtered output signal ($FB_{est1}$, $FB_{est2}$, respectively) providing an estimate of the respective feedback paths. As in the embodiment of FIG. 11*a*, the listening device of FIG. 11*b* can be can be adapted to be able to process information relating to the better ear effect, either derived solely from local information of the listening device itself (cf. FIG. 1), or to receive and process information relating to the better ear effect from another device via the optional wireless interface (antenna, transceiver Rx-Tx and signal WIN, indicated with a dashed line), whereby a binaural listening system comprising two listening devices located at left and right ears of a use can be implemented (cf. FIG. 2).

In both cases, the analysis unit (ANA) and the signal processing unit (SPU) comprises the necessary BEE Maximizer blocks (BEE Locator, and BEE Allocator, and Transposition engine, BEE Provider, storage media holding relevant data, etc.).

2.2. A Listening System

Figure 12A:
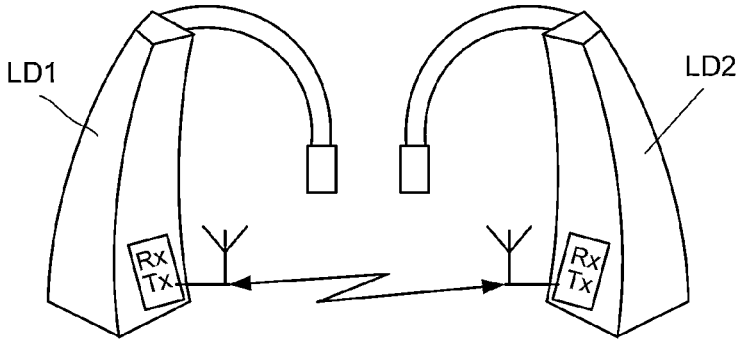
FIG. 12 shows an example of a binaural or a bilateral listening system comprising first and second listening devices LD1, LD2, each being e.g. a listening device as illustrated in FIG. 11*a* or in FIG. 11*b*.

FIG. 12*a* shows an example of a binaural or a bilateral listening system comprising first and second listening devices LD1, LD2, each being e.g. a listening device as illustrated in FIG. 11*a* or in FIG. 11*b*. The listening devices are adapted to exchange information via transceivers RxTx. The information that can be exchanged between the two listening devices comprises e.g. information, control signals and/or audio signals (e.g. one or more frequency bands of an audio signal, including BEE information).

Figure 12B:
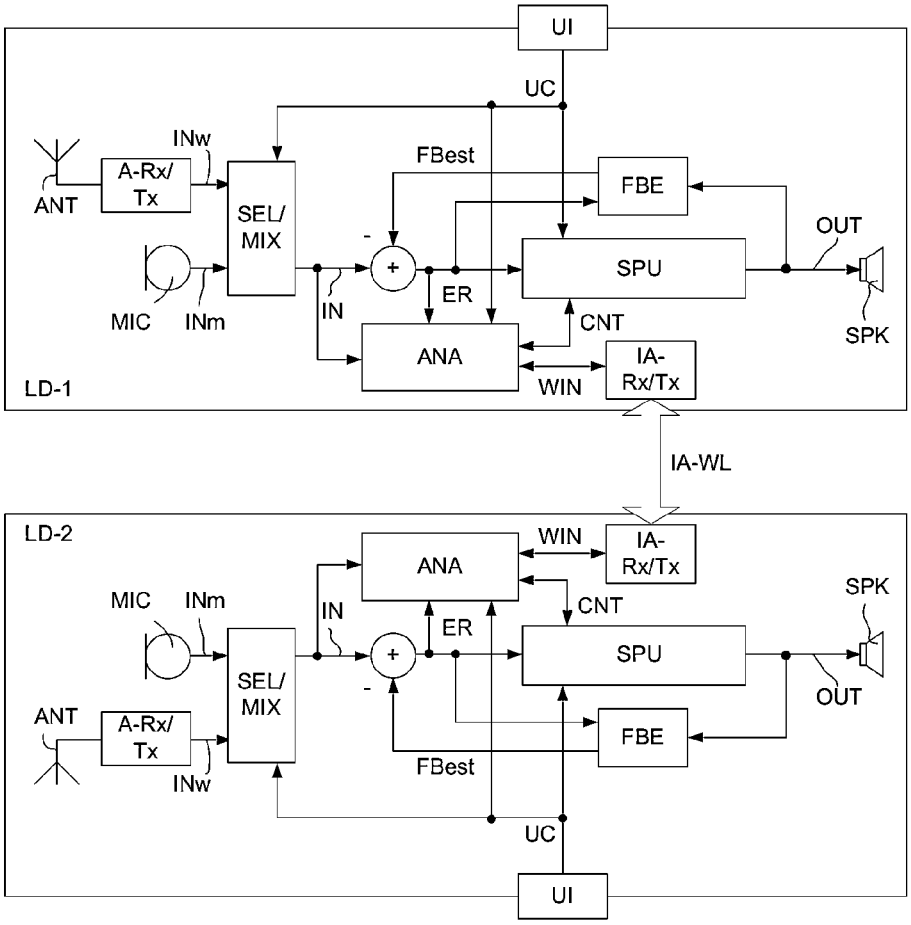

FIG. 12*b* shows an embodiment of a binaural or a bilateral listening system, e.g. a hearing aid system, comprising first and second listening devices (LD-1, LD-2), here termed hearing instruments. The first and second hearing instruments are adapted for being located at or in left and right ears of a user. The hearing instruments are adapted for exchanging information between them via a wireless communication link, e.g. a specific inter-aural (IA) wireless link (IA-WL). The two hearing instruments (LD-1, LD-2) are adapted to allow the exchange of status signals, e.g. including the transmission of characteristics of the input signal (including BEE information) received by a device at a particular ear to the device at the other ear. To establish the inter-aural link, each hearing instrument comprises antenna and transceiver circuitry (here indicated by block IA-Rx/Tx). Each hearing instrument LD-1 and LD-2 comprise a forward signal path comprising a microphone (MIC) a signal processing unit (SPU) and a speaker (SPK). The hearing instruments further comprises a feedback cancellation system comprising a feedback estimation unit (FBE) and combination unit ('+') as described in connection with FIG. 11. In the binaural hearing aid system of FIG. 12*b*, a signal WIN comprising BEE-information (and possibly other information) generated by Analysis unit (ANA) of one of the hearing instruments (e.g. LD-1) is transmitted to the other hearing instrument (e.g. LD-2) and/or vice versa for use in the respective other analysis unit (ANA) and control of the respective other signal processing unit (SPU). The information and control signals from the local and the opposite device are e.g. in some cases used together to influence a decision or a parameter setting in the local device. The control signals may e.g. comprise information that enhances system quality to a user, e.g. improve signal processing, information relating to a classification of the current acoustic environment of the user wearing the hearing instruments, synchronization, etc. The BEE information signals may comprise directional information (e.g. ILD) and/or one or more frequency bands of the audio signal of a hearing instrument for use in the opposite hearing instrument of the system. Each (or one of the) hearing instruments comprises a manually operable user interface (UI) for generating a control signal UC, e.g. for providing a user input to the analysis unit (e.g. for selecting a target signal among a number of signals in the sound field picked up by the microphone system (MIC)).

In an embodiment, the hearing instruments (LD-1, LD-2) each further comprise wireless transceivers (ANT, A-Rx/Tx) for receiving a wireless signal (e.g. comprising an audio signal and/or control signals) from an auxiliary device, e.g. an audio gateway device and/or a remote control device. The hearing instruments each comprise a selector/mixer unit (SEL/MIX) for selecting either of the input audio signal INm from the microphone or the input signal INw from the wireless receiver unit (ANT, A-Rx/Tx) or a mixture thereof, providing as an output a resulting input signal IN. In an embodiment, the selector/mixer unit can be controlled by the user via the user interface (UI), cf. control signal UC and/or via the wirelessly received input signal (such input signal e.g. comprising a corresponding control signal (e.g. from a remote control device) or a mixture of audio and control signals (e.g. from a combined remote control and audio gateway device)).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Bell and Sejnowski, 1995] Bell, A. J. and Sejnowski, T. J. *An information maximisation approach to blind separation and blind deconvolution*. Neural Computation 7(6):1129-1159. 1995.

[Boldt et al., 2008] Boldt, J. B., Kjems, U., Pedersen, M. S., Lunner, T., and Wang, D. *Estimation of the ideal binary mask using directional systems*. IWAENC 2008. 2008.

[Bronkhorst, 2000] Bronkhorst, A. W. *The cocktail party phenomenon: A review of research on speech intelligibility in multiple-talker conditions*. Acta Acust. Acust., 86, 117-128. 2000.

[Carlile et al., 2006] Carlile, S., Jin, C., Leung, J., and Van Schaick, A. *Sound enhancement for hearing-impaired listeners*. Patent application US 2007/0127748 A1. 2006.

EP1699261A1 (Oticon, Kjems, U. and Pedersen M. S.) Jun. 9, 2006

EP1742509 (Oticon, Lunner, T.) Oct. 1, 2007.

[Goodwin, 2008] Goodwin, M. M. *The STFT, Sinusoidal Models, and Speech modification*, Benesty J, Sondhi M M, Huang Y (eds): Springer Handbook of Speech Processing, pp 229-258 Springer, 2008.

[Gardner and Martin, 1994] Gardner, Bill and Martin, Kieth, *HRTF Measurements of a KEMAR Dummy-Head Microphone*, MIT Media Lab Machine Listening Group, MA, US, 1994.

[Jourjine et al., 2000] Jourjine, A., Rickard, S., and Yilmaz, O. *Blind separation of disjoint orthogonal signals: demixing N sources from 2 mixtures*. IEEE International Conference on Acoustics, Speech, and Signal Processing. 2000.

[Middlebrooks and Green, 1991] Middlebrooks, J. C., and Green, D. M. Sound localization by human listeners, Ann. Rev. Psychol., 42, 135-159, 2000.

[Neher and Behrens, 2007] Neher, T. and Behrens, T. *Frequency transposition applications for improving spatial hearing abilities for subjects with high-frequency hearing loss*. Patent application EP 2 026 601 A1. 2007.

[Pedersen et al., 2008] Pedersen, M. S., Larsen, J., Kjems, U., and Parra, L. C. *A survey of convolutive blind source separation methods*, Benesty J, Sondhi M M, Huang Y (eds): Springer Handbook of Speech Processing, pp 1065-1094 Springer, 2008.

[Pedersen et al., 2006] Pedersen, M. S., Wang, D., Larsen, J., and Kjems, U. *Separating Underdetermined Convolutive Speech Mixtures*. ICA 2006. 2006.

[Proakis and Manolakis, 1996] Proakis, J. G. and Manolakis, D. G. *Digital signal processing: principles, algorithms, and applications*. Prentice-Hall, Inc. Upper Saddle River, N.J., USA, 1996.

[Roweis, 2001] Roweis, S. T. *One Microphone Source Separation*. Neural Information Processing Systems (NIPS) 2000, pages 793-799 Edited by Leen, T. K., Dietterich, T. G., and Tresp, V. 2001. Denver, Colo., US, MIT Press.

[Schaub, 2008] Schaub, A. *Digital Hearing Aids*. Thieme Medical Publishers, 2008.

US 2004/0175008 A1 (Roeck et al.) Sep. 9, 2004.

[Wang, 2005] Wang, D. *On ideal binary mask as the computational goal of auditory scene analysis*, Divenyi P. (ed): Speech Separation by Humans and Machines, pp 181-197 Kluwer, Norwell, Mass. 2005.

[Wightman and Kistler, 1997] Wightman, F. L., and Kistler, D. J., *Factors affecting the relative salience of sound localization cues*, In: R. H. Gilkey and T. A. Anderson (eds.), *Binaural and Spatial Hearing in Real and Virtual Environments*, Mahwah, N.J.: Lawrence Erlbaum Associates, 1-23, 1997.

The invention claimed is:

1. A method of processing audio signals picked up from a sound field by a microphone system of a listening device adapted for being worn at a particular one of the left or right ear of a user, the sound field comprising sound signals from one or more sound sources, the sound signals impinging on the user from one or more directions relative to the user, the method comprising a) providing information about the transfer functions for the propagation of sound to the user's left and right ears, the transfer functions depending on the frequency of the sound signal, the direction of sound impact relative to the user, and properties of the head and body of the user;

b1) providing information about a user's hearing ability on the particular ear, the hearing ability depending on the frequency of a sound signal;

b2) determining a number of target frequency bands for the particular ear, for which the user's hearing ability fulfils a predefined hearing ability criterion;

c1) providing a dynamic separation of sound signals from the one or more sound sources for the particular ear, the separation depending on time, frequency and direction of origin of the sound signals relative to the user;

c2) selecting a signal among the dynamically separated sound signals;

c3) determining an SNR-measure for the selected signal indicating a strength of the selected signal relative to signals of the sound field, the SNR-measure depending on time, frequency and direction of origin of the selected signal relative to the user, and on the location and mutual strength of the sound sources;

c4) determining a number of donor frequency bands of the selected signal at a given time, where the SNR-measure for the selected signal is above a predefined threshold;

d) transposing at least one donor frequency band of the selected signal—at a given time—to a target frequency band, if a predefined transposition criterion is fulfilled.

2. A method according to claim 1 wherein the predefined transposition criterion comprises that the donor band comprises speech.

3. A method according to claim 1 wherein the transfer functions for the propagation of sound to the user's left and right ears comprise the head related transfer functions of the left and right ears $HRTF_l$ and $HRTF_r$, respectively.

4. A method according to claim 1 wherein in step c4) a better ear effect function related to the transfer functions for the propagation of sound to the user's left and right ears are based on an estimate of the interaural level difference, ILD, and wherein the interaural level difference of a potential donor frequency band is larger than a predefined threshold value $T_{ILD}$.

5. A method according to claim 1, wherein steps c2) to c4) are performed for two or more of the dynamically separated sound signals, and wherein all other signal sources than the selected signal are considered as noise when determining the SNR-measure.

6. A method according to claim 1 wherein in step c2) a target signal is chosen among the dynamically separated sound signals, and wherein step d) is performed for the target signal, and wherein all other signal sources than the target signal are considered as noise.

7. A method according to claim 6, wherein the target signal is selectable by the user via a user interface allowing a selection between the currently separated sound sources, or a selection of sound sources from a particular direction relative to the user.

8. A method according to claim 1 wherein signal components that are not attributed to one of the dynamically separated sound signals are considered as noise.

9. A method according to claim 1 wherein step d) comprises substitution of the magnitude and/or phase of the target frequency band with the magnitude and/or phase of a donor frequency band.

10. A method according to claim 1 wherein step d) comprises mixing of the magnitude and/or phase of the target frequency band with the magnitude and/or phase of a donor frequency band.

11. A method according to claim 1 wherein in step b2) a target frequency band is determined based on an audiogram.

12. A method according to claim 1 wherein in step b2) a target frequency band is determined based on the frequency resolution of the user's hearing ability.

13. A method according to claim 1, wherein target frequency bands that contribute poorly to the user's current spatial perception and speech intelligibility are determined, such that their information may be substituted with the information from a donor frequency band.

14. A method of operating a bilateral hearing aid system comprising left and right listening devices each being operated according to a method as claimed in claim 1.

15. A method according to claim 14 wherein step d) is operated independently in left and right listening devices.

16. A method according to claim 14 wherein step d) is operated synchronously in left and right listening devices in that the devices share the same donor and target band configuration.

17. A non-transitory tangible computer-readable medium storing instructions for causing a data processing system to perform the steps of the method of claim 1, when said instructions are executed on the data processing system.

18. A listening device adapted for being worn at a particular one of the left or right ear of a user, comprising:

a microphone system for picking up sounds from a sound field comprising sound signals from one or more sound sources, the sound signals impinging on the user wearing the listening device from one or more directions relative to the user;

a forward path from the microphone system to an output transducer, the forward path including a processing unit configured to provide information about transfer functions for propagation of sound to the user's left and right ears, the transfer functions depending on a frequency of the sound signals, the direction of sound impact relative to the user, and properties of the head and body of the user, provide information about a user's hearing ability on the particular ear, the hearing ability depending on the frequency of the sound signal, determine a number of target frequency bands for the particular ear, for which the user's hearing ability fulfils a predefined hearing ability criterion, provide a dynamic separation of sound signals from the one or more sound sources for the particular ear, the separation depending on time, frequency and direction of origin of the sound signals relative to the user, select a signal among the dynamically separated sound signals, determine an SNR-measure for the selected signal indicating a strength of the selected signal relative to signals of the sound field, the SNR-measure depending on time, frequency and direction of origin of the selected signal relative to the user, and on the location and mutual strength of the sound sources, determine a number of donor frequency bands of the selected signal at a given time, where the SNR-measure for the selected signal is above a predefined threshold; and transpose at least one donor frequency band of the selected signal, at a given time, to a target frequency band, if a predefined transposition criterion is fulfilled.

19. A bilateral hearing aid system comprising left and right listening devices, each of the listening devices being according to claim 18.

* * * * *